US008327611B2

(12) United States Patent
Carmelo Calvano

(10) Patent No.: US 8,327,611 B2
(45) Date of Patent: Dec. 11, 2012

(54) METHODS FOR THE JOINT WRAPPING OF BAGS WITH THEIR CONTENTS, APPLYING MACHINE AND PACKET OF BAGS CONTAINING "SNACK" THUS OBTAINED

(76) Inventor: Ferrucchio Carmelo Calvano, Capital Federal (AR)

( * ) Notice: Subject to any disclaimer, the term of this patent is extended or adjusted under 35 U.S.C. 154(b) by 343 days.

(21) Appl. No.: 12/439,777

(22) PCT Filed: Sep. 4, 2007

(86) PCT No.: PCT/IB2007/002548

§ 371 (c)(1),
(2), (4) Date: Jun. 1, 2009

(87) PCT Pub. No.: WO2008/029250

PCT Pub. Date: Mar. 13, 2008

(65) Prior Publication Data

US 2010/0018162 A1 Jan. 28, 2010

(30) Foreign Application Priority Data

Sep. 4, 2006 (AR) ..... P060103859
Sep. 3, 2007 (AR) ..... P070103892

(51) Int. Cl.
*B65B 35/50* (2006.01)

(52) U.S. Cl. ..... 53/540; 53/447; 53/451; 53/551

(58) Field of Classification Search ..... 53/451, 53/439, 469, 447, 437, 438, 475, 526, 529, 53/540, 551, 552, 171, 284, 244, 245
See application file for complete search history.

(56) References Cited

U.S. PATENT DOCUMENTS

| | | | | |
|---|---|---|---|---|
| 3,604,181 | A | 9/1971 | Adcox | |
| 3,641,735 | A * | 2/1972 | Daily et al. | 53/537 |
| 3,959,951 | A | 6/1976 | Paules | |
| 4,027,460 | A * | 6/1977 | Orr | 53/535 |
| 4,045,940 | A | 9/1977 | White et al. | |
| 4,202,152 | A * | 5/1980 | Coles | 53/451 |
| 4,353,196 | A * | 10/1982 | Beer et al. | 53/451 |
| 4,703,765 | A * | 11/1987 | Paules et al. | 131/112 |
| 4,790,124 | A * | 12/1988 | Kaji | 53/552 |
| 5,029,431 | A | 7/1991 | Weening et al. | |
| 5,088,271 | A * | 2/1992 | Westaway | 53/515 |
| 5,117,614 | A | 6/1992 | Johnsen | |
| 5,127,212 | A | 7/1992 | Johnsen et al. | |
| 6,070,395 | A | 6/2000 | Calvano | |
| 6,564,528 | B1 | 5/2003 | Keegan | |
| 6,708,465 | B1 | 3/2004 | Gustafsson | |
| 6,732,498 | B2 * | 5/2004 | Keen et al. | 53/567 |
| 6,837,030 | B2 | 1/2005 | Drebing et al. | |
| 6,968,669 | B2 * | 11/2005 | Schroeder et al. | 53/410 |
| 7,096,650 | B2 | 8/2006 | Van Dam | |
| 7,228,673 | B2 * | 6/2007 | Sugimura et al. | 53/154 |
| 2007/0157579 | A1 | 7/2007 | Basque et al. | |

FOREIGN PATENT DOCUMENTS

EP 0 784 011 7/1997

* cited by examiner

*Primary Examiner* — Thanh Truong
(74) *Attorney, Agent, or Firm* — King & Schickli, PLLC

(57) ABSTRACT

A machine for forming a bale including a plurality of bags includes a conveyor for conveying each of the bags to an inlet opening. A film feeder is positioned adjacent the inlet opening, along with a former for forming a sleeve from the film adjacent to the inlet opening. Means for pushing, such as a pusher, is provided for pushing the bags into the sleeve. Related methods are also disclosed.

28 Claims, 13 Drawing Sheets

METHODS FOR THE JOINT WRAPPING OF BAGS WITH THEIR CONTENTS, APPLYING MACHINE AND PACKET OF BAGS CONTAINING "SNACK" THUS OBTAINED

FIELD OF THE INVENTION

The present invention refers to methods for packaging filled bags together into a single unit or package, and it also refers to machines utilized to implement said methods. The present invention is especially aimed at packaging together bags containing fragile foodstuffs characterized as "snacks" (thus referred to henceforward in this description), such as potato chips, cheese puffs, pretzel sticks, cheese straws, corn chips, peanuts and others, which must reach the consumer in substantially whole condition.

BACKGROUND OF THE INVENTION

In the packaging industry, one of the best known ways of selling solid products in pieces, granules and/or powder is by dividing and packing them into either paper or plastic bags, the latter being more widely used in recent times due to their greater strength, impermeability and optimum airtightness.

Particleized or finely divided products behave in a manner similar to liquids and, due to the flexible nature of the laminar container in which they are packaged, this container changes shape in a variable manner due to the weight and shifting of their contents, thus making it difficult to store, transport or even to handle them in large quantities.

For this reason, it has become necessary to package the bags together, which is usually accomplished by means of boxes, which are used for the delivery of products separated into bags to the wholesale, retail and distribution sectors.

Boxes undoubtedly offer a number of advantages, although since cardboard has a hygroscopic nature, it is often the main factor in the deterioration of merchandise due to its absorption of moisture. This aspect, added to the relatively high cost of cardboard boxes, makes it advisable to substitute other more economical and waterproof materials.

Developing methods and machinery for packing bags containing small particles in such a way that they can be packaged together in plastic wrapping has long been contemplated, but for some time a series of technical difficulties were encountered, which have now been solved, making it possible to package a group of bags together.

The main difficulties have been the irregularity of the contours of the container due to the shifting of the contents, the fragility of the bag walls which render unsafe the use of ad hoc metal machine parts for the purpose of moving them around, and so forth.

The primary solution consists of tubular plastic wrapping that is closed at one end, into which the bags are manually loaded prior to sealing the opposite end to form a package.

This process, besides being slow and expensive, is awkward because of the variations of shape and size taken by the bags when they are filled, so that when they are manually loaded, if the sleeve is tight, the rubbing or folding of the bags produces an irregular stack requiring repacking, whereas if the sleeve is loose, the merchandise does not get properly packed, giving rise to a risk of breakage.

In the snack-packaging industry, in particular, one of the best known ways of selling these products is to separate and bag them, currently in small plastic bags the material of which is usually several layers thick in order to achieve greater strength, impermeability and optimum airtightness.

In addition, it has become necessary to package the snack bags together, generally accomplished by means of boxes, which are used for the delivery of these products to the wholesale, retail and distribution sectors.

Currently, the snack bags are usually placed manually into cardboard boxes when they emerge from the endpoint of the packing machines, permitting the handling of a number of bags together as a unit for their loading, unloading, shipping and transport, while protecting their integrity.

However, this packing into boxes complicates the shipping and handling of the units, since the person responsible for making deliveries to the points of sale must open the boxes in order to deliver fewer units than the boxes contain to fill orders of less than their total number of units or slightly more, which leads to complications in the whole distribution process.

On the other hand, as previously mentioned, although the boxes do offer advantages, their absorption of moisture causes problems during shipment, given the hygroscopic nature of cardboard, which, added to the relatively high cost of cardboard boxes, makes it advisable to substitute other materials that are more economical and waterproof.

Developing methods and mechanisms to prepare bags containing fragile foodstuffs like snacks in such a way that they can be packaged together in plastic wrapping has long been contemplated, but for some time a series of technical difficulties were encountered, which have now been solved, making it possible to package multiple bags together.

These packages of bags or "bundles" can contain a specified number of units, but less than the content of the aforementioned boxes, making the process of distribution and delivery to the different points of sale much simpler and avoiding the handling of individual units when boxes are opened to make deliveries of a small number of units.

The main difficulties have been the irregularity of the contours of the container due to an irregular distribution of their contents, the fragility of the bag walls which render unsafe the use of ad hoc metal machine parts for the purpose of handling them, and so forth. These individual bags normally contain air in their interior, which keeps them slightly inflated as a protection against crushing that would lead to breakage by compression of their contents.

A primary solution consists of tubular plastic wrapping that is closed at one end, into which the bags are manually loaded prior to sealing the opposite end to form a package.

This process, besides being slow and expensive, is awkward because of the variations of shape and size taken by the bags when they are filled, so that when they are manually loaded, if the sleeve is tight, the rubbing or folding of the bags produces an irregular stack requiring repacking, whereas if the sleeve is loose, the merchandise does not get properly packed, giving rise to a risk of breakage.

Patent No. AR 000660 B1 describes a method for packaging bags in a laminar wrapping or thin plastic sheet shaped into the form of a sleeve by a totally automated machine, with a large output and a high level of safety, making possible considerable savings and a high rate of production for these packaging systems.

In addition, there is the special feature that the resulting packaging creates undersides that are more or less flat, making it possible for the package to stand on end, thus facilitating its stacking in warehouses, stores or transport.

However, despite the advantages achieved by this method and machine, there are high-output packaging lines which require even greater response speeds to accomplish the packaging of bags filled with the separated products.

Furthermore, the filling of the sleeve containing the individual packets, once closed, contains a residual empty space, which allows the individual packets to become disarranged during their handling, making the lot problematic to load and unload.

Therefore, the present invention constitutes a solution to these problems that makes possible the packaging into sleeves of individual packets of materials divided into bags, resulting in a greater response speed for high-output lines and in the production of a much more compact package that is easy to load and unload.

For all these reasons, one can imagine the acceptance the invention will have when put into practice, however categorized or used, by virtue of its defining characteristics, it lends itself equally well to application in the packaging of grains, particulate materials such as sugar, corn flour, wheat flour, granular material, gelatins, medicinal herbs, and so forth.

Furthermore, this invention is expected to have an even greater acceptance when used for the packaging of bags containing snack foods, given the fragility and weight of the contents of these individual bags.

SUMMARY OF THE INVENTION

For the specified purposes, a method is proposed for the packaging together of filled bags, wherein the bags contain a product in the form of pieces, granules or powder, and are intended to be packed one on top of another, forming a stack which fits inside an elongated thermo-adhesive plastic laminar wrapping, joined along its longitudinal edges to form a sleeve closed at its bottom and at its laminar top side by means of welded seams at each place. Said method comprises the following stages:

a) advance of the flat-lying bags along a conveyor that comprises a lower first belt and an upper second belt for elevating and transferring;

b) delivery of at least one first bag onto a support in such a way that while the bag is on this support at one side of an opening of a tube forming a sleeve located above the bottom of the elongated laminar wrapping, it gives the welding means time to close said bottom side by means of a transverse welded seam;

c) partial shaping over the sleeve-forming tube of a continuous laminar wrapping closed longitudinally by welding in the form of a sleeve with its bottom side welded according to step b) for the bags;

d) horizontal pushing of a first bag from its position on the support toward the adjacent opening of the sleeve-forming tube, said bag remaining supported on the edge of said opening;

e) vertical pushing to cause the joint descent of the first bag and the wrapping, at the same time that the sleeve is closed with seams produced longitudinally on one of its lateral sides as it is caused to descend with the bags contained inside it;

f) continued feeding of bags onto the support by pushing them first horizontally, thus causing them to move into the adjacent opening of the sleeve-forming tube, and then vertically, causing the descent of the whole arrangement until the package is completed by stacking in its interior a preset number of bags wrapped in the sleeve; and g) closure of the laminar top side of the package shaped by the sleeve once it is complete, by means of a transverse weld across the laminar top side, and separation of the shaped package by means of a cut in such a way that, at the same time, the bottom of the wrapping of the next package is formed.

In a second aspect of the present invention, a bag-wrapping machine mounted on a vertical frame is also provided, the machine being applicable to the method previously described and comprising:

synchronized endless belt conveyance means that comprise a lower first belt and an upper second belt for elevating and transferring arranged in different parallel and overlapping planes in such a way that between the two planes a passageway is formed for transit of the filled bags toward a support;

a feeder of laminar thermo-adhesive plastic film which, with corresponding guiding rollers and tightening members, feeds into a chamber shaping the wrapping sleeve for the bags stacked one on top of another, where said chamber comprises a shoulder and a sleeve-forming tube, with the sleeve being partially formed starting from a transverse welded bottom seam which creates its bottom side;

horizontal welding means at the bottom and top of the wrapping, as well as vertical welding means used to join the overlapping longitudinal edges of the laminar wrappings with the horizontal welding means being located underneath the outlet of the sleeve-forming tube and comprising thermal clamps used to form a transverse welding to close the top side of the wrapping of each package and the corresponding bottom side of the next package, with a cutting mechanism to separate the formed packages from each other, with said horizontal sealing elements to include blowing means which make a gusset of the sleeve; while the vertical welding means are composed of a set of thermal clamps located on a plane below that of the support and above the sleeve-forming tube, coinciding with the line of overlap between the longitudinal edges of the wrapping;

said machine characterized in that it further comprises:

a bag intake box formed by an enclosure that internally comprises the horizontal support of the bags that are delivered by the conveying means and an adjoining opening for entry into the sleeve-forming tube;

horizontally-acting pushing means that activates a movably mounted plate which sweeps the surface of the horizontal support toward the opening of the sleeve-forming tube; and vertically-acting pushing means located over said intake box and the axis of action of which is collinear with the axis of the sleeve-forming tube located beneath it, where said vertically-acting pushing means comprise on their end a plate which, upon being activated, leans on the at least one bag supported over the opening of the sleeve-forming tube, pushing the formed sleeve and its contents through the outlet of the sleeve-forming tube toward the horizontal welding means.

Also, in a third aspect of the present invention, a method is proposed for packaging snack-filled bags together, in which the bags will be packed one on top of one another, forming a stack which fits within an elongated laminar wrapping of thermo-adhesive plastic joined along its longitudinal edges to form a sleeve closed on its bottom side and at its laminar top side by means of welded seams at each place, said method being characterized in that it comprises the following steps:

a) advance of the flat-lying bags along a horizontal conveyor belt toward a vertical-lifting elevator wheel;

b) elevation of the bags, pushing them individually toward a horizontal conveyor which comprises a lower first belt and an upper second belt that carry them over an opening of a sleeve-forming tube located above the bottom of an elongated laminar wrapping, giving the welding means time to produce the closure of said bottom side by means of a transverse welded seam;

c) partial shaping over the sleeve-forming tube of a continuous laminar wrapping closed longitudinally by welding in the form of a sleeve with its bottom side welded according to step b) for the bags;

d) placement of at least one or more bags stacked over the opening of the sleeve-forming tube;

e) vertically pushing to cause the joint descent of the first bags and the wrapping, at the same time that the sleeve is closed with seams produced longitudinally on one of its lateral sides as it is caused to descend with the bags contained inside it;

f) continuing to feed the bags in which at least one or more stacked bags are placed over the opening of the sleeve-forming tube and then pushed downward, causing the descent of the stack a number of times until the package is completed by stacking a predetermined number of bags inside the sleeve; and g) closure of the laminar top side of the package shaped by the sleeve once it is complete, by means of a transverse weld, and separation of the formed package by means of a cut in such a way that at the same time, the bottom of the wrapping of the next package is formed.

Optionally, the corners of the individual bags are folded in as they pass through a pre-former at the mouth of the sleeve-forming tube to avoid friction and tearing of the sleeve by the protruding corners of the individual bags, thus facilitating a close fit of the bags being packed into the sleeve.

In yet a fourth aspect of the present invention, a machine, applicable to the method previously described, mounted on a vertical frame is also provided for the packaging of snack-filled bags. It comprises:

synchronized interlinked conveying means which comprise: a horizontal conveyor belt, a vertical-lifting elevator wheel and a set of horizontal conveying means comprising a lower first belt and an upper second belt, arranged in different parallel planes, one above the other, in such a way that between the two a passageway is formed for transit of the filled bags toward the opening of a sleeve-forming tube which comprises means of support;

a feeder of laminar thermo-adhesive plastic film which, with corresponding guiding rollers and tightening members, feeds into a chamber for shaping the wrapping sleeve for the bags stacked one on top of another, where said chamber comprises a shoulder and a sleeve-forming tube, with the sleeve being partially formed starting from a transverse welded lower seam which creates its bottom side;

horizontal welding means at the bottom and top of the wrapping, as well as vertical welding means used to join the overlapping longitudinal edges of the laminar wrapping, with the horizontal welding means being located underneath the outlet of the sleeve-forming tube and comprising thermal clamps used to form a transverse weld to close the top surface of the wrapping of each package and the corresponding bottom side of the next package, with cutting means to separate the formed packages from each other, with said horizontal-welding means to include blowing means which make a gusset of the sleeve; while the vertical welding means are composed by a set of thermal clamps located on a plane below that of the opening (130) of the sleeve-forming tube (115) and over said sleeve-forming tube, coinciding with the line of overlap between the longitudinal edges of the wrapping; said machine also comprises:

horizontally-acting pushing means that act upon a movably-mounted plate which pushes the individual bags from their position in the elevator wheel toward the horizontal conveyor belt mechanisms;

a bag intake box formed by an enclosure that internally comprises an opening for entry into the sleeve-forming tube of the bags which are delivered by the horizontal conveying means;

vertically-acting pushing means located over said intake box and the axis of action of which is collinear with the axis of the sleeve-forming tube located beneath it, where said vertically-acting pushing means comprise on their end a plate and, upon being activated, said means lean on the at least one bag supported over the opening of the sleeve-forming tube, pushing the formed sleeve and its contents through the outlet of the sleeve-forming tube toward the horizontal welding means; and.

an exit belt (132) located in front of and beneath the sleeve-forming tube (115) for transport of the formed packages.

Preferentially, the entry opening to the sleeve-forming tube offers means of support around its perimeter that keep the at least one bag or the stack of at least two bags suspended until the vertical-acting pushing means introduce them into the sleeve.

Also preferentially, the opening of the sleeve-forming tube comprises a pre-former which makes the corners of the individual snack-filled bags fold in over their sides as they pass across it, in order to avoid the tearing of the sleeve by the projecting corners and to facilitate the close fit of the bags being packed into the sleeve.

BRIEF DESCRIPTION OF THE DRAWINGS

For greater clarity and understanding of the subject of the present invention, said subject is illustrated with various Figures in which it has been depicted in its preferred embodiments, for illustrative purposes, but without limitation:

FIG. 13 is a series of views of a preferred embodiment of the pre-former, in which FIG. 13A is a side view showing its position over the sleeve-forming tube, FIG. 13B is a top plan view, FIG. 13C is a perspective drawing, and FIG. 13D is a side plan view of the same.

Figure 1:
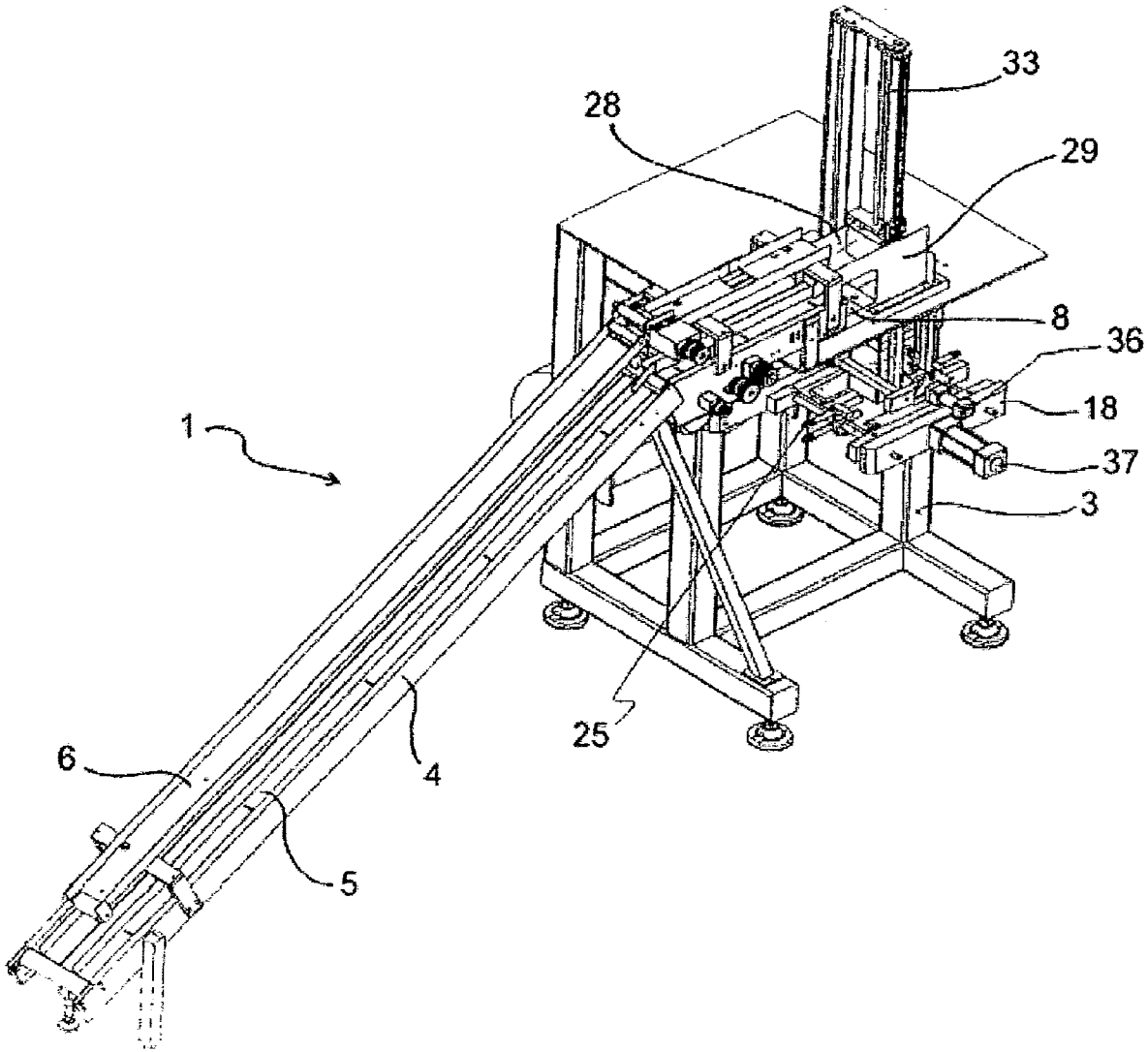
FIG. 1 is a front perspective view from above of a preferred embodiment of the machine subject of the present invention, showing its main parts: sloping conveyor belt with its upper transfer belt, horizontal conveyor belt with its upper transfer belt, horizontally-acting means to push the bags from a support to the opening of a sleeve-forming tube, vertically-acting pushing means which cause the sleeve to advance as said sleeve is being formed by pushing the bags into the package, cylinders of vertical and horizontal sealing, gusset former and reel of plastic film used to make the wrapping sleeve of the bundle or package, all mounted on a supporting frame.

In the Figures in which arrows appear, these indicate the direction of forward movement during the bag-packaging process according to any of the proposed embodiments of this invention.

DETAILED DESCRIPTION OF THE INVENTION

Method for Wrapping Product-Filled Bags Together

In general terms, in a first aspect of the present invention, a method is provided for wrapping product-filled bags together, wherein the bags are filled with a product in the form of pieces, granules or powder, the bags being intended to be packed one on top of another, forming a stack which fits inside an elongated thermo-adhesive plastic laminar wrapping, joined along its longitudinal edges to form a sleeve closed at its bottom and at its laminar top wall by means of welded seams at each place.

The referenced method is characterized in that it comprises the following steps:

a) advancing the flat-lying bags along a conveyor which comprises a lower first belt and an upper second belt for lifting and transferring;

b) delivering at least a first bag onto a support so that, while the bag is on this support, at one side of the opening of a sleeve-forming tube located over the bottom of the elongated laminar wrapping, providing time for the welding means to close said bottom with a transverse welding seam;

c) partially shaping over the sleeve-forming tube a continuous laminar wrapping longitudinally closed by welding in the shape of a sleeve with its bottom welded according to step b) for the bags;

d) horizontally pushing a first bag placed on the support toward the adjacent opening of the sleeve-forming tube, remaining supported on the edge of said opening;

e) vertically pushing causing the joint descent of the first bag and wrapping, at the same time that the sleeve is closed with longitudinal seams on one of its sides while the sleeve is descending with the bags inside it;

f) continuing to feed bags onto the support by pushing them first horizontally, thus causing them to move into the adjacent opening of the sleeve-forming tube, and then vertically, causing the descent of the whole arrangement until the package is completed by stacking a predetermined number of bags inside the sleeve; and g) closing of the laminar top side of the package shaped by the sleeve once it is complete, by means of a transverse weld, and separation of the formed package by means of a cut in such a way that at the same time, the bottom of the wrapping of the next package is formed.

More specifically, said space over the aforementioned support fed by the conveyor is intended for the temporary accumulation of at least one bag and is located on one side adjacent to an opening of the vertical sleeve-forming tube which is an extension of a forming shoulder, both tube and shoulder being constituent elements of a sleeve-forming chamber. The forming shoulder surrounds the sleeve-forming tube and is responsible for bending the elongated thermo-adhesive plastic laminar wrapping into the shape of a sleeve over the sleeve-forming tube upon which the sleeve is longitudinally sealed.

Horizontally-acting means for pushing are responsible for moving the bags located on the support toward the opening of the adjacent sleeve-forming tube. Preferentially, the horizontally-acting means are a pneumatic or hydraulic cylinder.

The successive descent of the package comprising the bags and their wrapping is caused by the action of vertical pushing which causes a plate to press down on the bags supported on the edge of the opening of the sleeve-forming tube while the bags are being forced into said wrapping, at intervals determined by the introduction of each consecutive at least one bag.

Furthermore, the vertically-acting means of pushing are responsible for forcing the bags that were previously pushed horizontally, now pushing them down inside the sleeve that is being formed as the sleeve is being filled, thus preventing the bags from being left loose in the interior of the package and causing the joint descent of the bags and sleeve. Preferentially, the vertically-acting means may be a servomechanism driven by sensors and run stoppers which take it from one position to another and sequentially define the position and the run to adopt according to the package-filling step.

The longitudinal seams created on the laminar material at one of its sides to shape the wrapping sleeve can be discontinuous, that is to say, a series of short parallel welds side by side in such a way that they give the appearance and produce the effect of a continuous weld. These seams are made during the descent of the sleeve with the bags contained inside, pushed by the vertically means of action. Said discontinuous seams may be oblique to the longitudinal edges of the film to facilitate the task during the descent of the whole package.

Thus, very compact packages result, formed by the sleeve obtained from the laminar material wrapped around the stack of filled bags, which is closed on its upper and lower surfaces by the respective transverse and longitudinal seams. During the whole process, the sleeve is closed by the joining of its overlapping longitudinal edges by the aforementioned longitudinally-made seams.

Preferentially, the closing by welding of the wrapping bottom is made together by a blowing against two of the opposing lateral walls of said wrapping, thus creating the gradual formation of each longitudinal gusset.

The closing by welding of the package of bags is made at the same time that the closing by welding of the bottom of the immediately following package is accomplished, and then a cut is made to separate the closed packages, thus forming the bottom of the wrapping of the next package.

In turn, the closing by transverse welding of step g) may be either a welding strip cut along its middle, or else the closing by transverse welding of step g) may be double and the cut made on the existing empty space between the two welding seams.

For the purpose of compactly closing the package with a predetermined number of bags using the closing transverse weld of step g), when the loading of bags inside the sleeve is finished there must be a horizontal sealing area at the midpoint of the distance between the lower edge of the sleeve-forming tube and the upper surface of the last bag, said distance being equal to the distance between the center of the package and the side of the sleeve on which is formed the transverse closing weld for the top side of the package wrapping, and the bottom corresponding to the wrapping of the next package.

The method for wrapping product-filled bags together optionally provides before step d), for the delivery of at least a second bag on top of the previous one placed on the support, such that the second bag is stacked on top of the first one.

The method for wrapping product-filled bags together optionally provides that step f) comprises the feeding of bags to the support so as to form stacks of two or more bags, then to push them first horizontally, causing their movement to the adjacent opening of the sleeve-forming tube, and then vertically, producing the joint descent of the bags and sleeve until the package is completed, stacking up in its interior a predetermined number of bags wrapped by the sleeve.

In a preferred embodiment, the inlet opening to the sleeve-forming tube comprises on its edge means of support for the bags. In one embodiment of the invention, these means are simply mouth flaps arranged in parallel and facing each other on opposite sides of the inlet opening to the sleeve-forming tube.

In another embodiment of the present invention, a machine is described with which the referred-to method can be implemented, and which shows some similarities to that described in AR 000660 B1, a document that is incorporated herein in its entirety for reference.

Machine to Wrap Product-Filled Bags Applicable to the Method Previously Described Then, a second aspect of the present invention provides a machine mounted on a vertical frame (1) for the wrapping of bags (2) which is applicable to the method in the foregoing description, and which comprises the following elements (3):

synchronized endless belt means of conveyance (4) comprising a lower first belt (5) and an upper second belt (6) for lifting and transferring, arranged in overlapping and parallel planes such that between them a passageway (7) for the filled bags (2) towards a support (8) is formed;

a feeder (9) of laminar film or thermo-adhesive plastic sheeting (10) which, with the corresponding guiding rollers (11) and tension members (12), feeds a sleeve-forming chamber (13) with wrapping for the stacked bags (2), wherein said chamber (13) comprises a shoulder (14) and a sleeve-forming tube (15), with said sleeve (16) being partially formed from a lower transverse welding seam creating its bottom (17);

horizontal welding means (18) of the bottom (17) and top of the wrapping, as well as vertical welding means (19) for joining the corresponding overlapping longitudinal edges (20) of the wrapping film (10), of which the horizontal welding means (18) are arranged under the outlet (35) of the sleeve-forming tube (15) and comprise thermal clamps (21) used to form a transverse closing weld (22) of the top wall of the wrapping of each package (23) and the bottom (17) corresponding to the wrapping of the next package (23) with a means of cutting (24) to separate the two formed packages (23) from each other, said horizontal welding means (18) to include means of blowing (25) to shape a gusset (26) in the sleeve (16); while the vertical welding means (19) are formed by a set of thermal clamps (21) located on a plane lower than that of the support (8) and over the sleeve-forming tube (15) and coinciding with the line of overlap between the longitudinal edges (20) of the wrapping;

said machine (1) characterized in that it further comprises:

an intake box (28) for the bags (2), formed by an enclosure (29) which internally comprises the horizontal support (8) for the bags (2) that are delivered by the means of conveyance (4) and an adjacent inlet opening (30) to the sleeve-forming tube (15);

horizontally-acting means of pushing (31) that act upon a movably mounted plate (32) which sweeps the surface of the horizontal support (8) toward the opening (30) of the sleeve-forming tube(15); and vertically-acting means of pushing (33) located over said intake box (28) and the axis of action of which is collinear with the axis of the sleeve-forming tube (15) which is located underneath, wherein said vertically acting pushing means (33) include at their end a plate (34) which when activated leans on the at least one bag supported on the opening (30) of the sleeve-forming tube (15) pushing the formed sleeve (16) and its content through the outlet (35) of the sleeve-forming tube (15) toward the horizontal welding means (18).

This machine (1) allows bags (2) to be received on a support (8) located inside an intake box 28), said bags being pushed first horizontally towards the inlet of the sleeve-forming tube (15) which is internal to the sleeve (16) being formed, and then vertically with ad hoc mechanical means to further the advance of the sleeve (16) being formed, thus accelerating packaging time and preventing empty spaces from being left in the interior of the package (23) which would decrease its stability.

The machine (1) comprises a vertical truss (3) or frame that has in its upper part a horizontally-acting pushing mechanism which moves the bags (2) that are deposited on a supporting space (8) into the intake box (28) by collection from an inclined conveyor and a horizontal one with the bags (2) containing products in pieces, granules and/or powdered form.

Simultaneously, on lower levels aligned with the intake box, (28) a sleeve-forming chamber (13) is mounted, comprising the forming shoulder (14) and the sleeve-forming tube (15), the vertical and horizontal welding means, and the reel (40) with the whole feeding system (9) of the flat plastic wrapping film (10).

More specifically, the truss (3) is a body formed by two large upright columns resting on a base or legs which support the entire structure, and to which are affixed the rail bars that constitute the support for the clamp-bearing bars of the horizontal welding system, as well as the axis of the reel (40) with the plastic sheet (10), the guiding rollers, the sleeve-forming top and other mechanisms and devices, driven by one or two motors through gearboxes, motion transmitters, etc., which are not detailed here as they are not relevant to the purposes of of the present invention and which can be implemented in many different ways which differ only in their construction.

The shaping device forms the polyethylene sleeve (16) which, when it is closed laterally, slides the areas adjacent to the longitudinal edges (20) superimposed between the jaws of a system of vertical welding means (19) that produce oblique and discontinuous transverse seams (38), any time that the sleeve (16) stops, and to the extent of its advance. The sliding movement of this piece is achieved through a vertical sealing cylinder (36).

The means of conveyance (4) of the machine (1) according to the present invention comprise an inclined first conveyor and a horizontal second conveyor downloading on the horizontal support (8) of the intake box (28). Optionally, the outlet of the horizontal second conveyor comprises two lateral pressing arms which, with fitting ends, make the bags (2) laterally uniform, if necessary, according to the type of product being packaged.

Both the inclined conveyor and the horizontal conveyor may be of the endless belt or strap kind, and above them are other minor belt conveyors, the wheels of which turn in the opposite direction of the conveyor movement, producing a common direction of advance toward the stacking system which comprises the intake box (28) with its support (8) before the sleeve-forming tube (15). Preferentially, the conveyors are driven electromechanically by an electric motor with a gearbox (39).

The distance between the belts of each conveyor is such that the bag fits closely between them to facilitate its movement.

As was previously said, the conveyor advances with a uniform linear motion and ends its advance at the intake box (28) which comprises the stacking support (8) and behind the inlet to the sleeve-forming tube (15) around which the sleeve (16) is formed.

This box consists of a frame or enclosure (29) of four erect walls the upper edges of which are located below the plane comprising the upper portion of the horizontal belt, demarcating a cavity with a support (8) compatible with the shape and size of each bag.

Preferentially, the front wall of the enclosure (29) may comprise an inspection window (27), which may preferentially be closed with a clear medium such as, for example, an acrylic plate.

Also preferentially, the horizontal pushing means (31) comprise a horizontal, preferentially pneumatic or hydraulic, pushing cylinder.

In a preferred embodiment, the inlet opening (30) to the sleeve-forming tube (15) comprises on its edge means of support for the bags (2). In one embodiment, these means are simply mouth flaps arranged in parallel and facing each other on opposite sides of the inlet opening (30) to the sleeve-forming tube (15).

Preferentially, the vertical pushing means (33) comprise a servomechanism, and the plate (34) of the vertical pushing means (33) is concave.

The wrapping machine (1) may then comprise an intake box (28) which is made up of an enclosure (29) with rigid walls, the front one optionally comprising an inspection window (27), which demarcate a space the capacity of which is compatible with the flat-lying bags (2) that enter said cavity, wherein the upper part of said space is open, while the lower part constitutes a support (8) for the bags (2) and adjacent to said support is the opening (30) of the sleeve-forming tube (15), wherein the support (8) side is composed of a plate (32) associated with a horizontal pushing cylinder (31) that moves the bags (2) over the mouth of the sleeve-forming tube (15) freeing up the support (8), so that next a vertically-acting servomechanism (33) pushes the bags (2) with an associated plate (34) at its lower end through said sleeve-forming tube (15) and inside the wrapping sleeve (16), wherein the aforementioned box is fed with bags (2) by the means of conveyance (4), and wherein the plate (32) of the horizontal pushing cylinder is activated in response to the admission of at least one bag to the cavity of the box by a sensor, the plate (34) of the vertically-acting servomechanism (33) is activated in response to the transfer of at least one bag to the opening (30) of the forming tube (15) by another sensor and the welding clamps are activated in response to a sensor which counts the bags (2) that pass through the sleeve-forming tube (15).

A sensor for the intake of each bag is an electric eye that detects when at least one bag has completely entered said intake box (28) on the support (8), triggering the push of the horizontal pushing cylinder to place the at least one bag over the opening (30) of the wrapping sleeve-forming tube (15).

A detection sensor over the opening (30) of the sleeve-forming tube (15) is an electric eye that detects when the at least one bag has been placed over the opening (30) of the sleeve-forming tube (15), triggering the activation of the vertical pushing servomechanism to push said bag through the mouth of the sleeve-forming tube (15), causing the advance of the bags (2) and sleeve (16) together.

A sensor in the sleeve-forming tube (15) is an electric eye which, by detecting when a predetermined number of bags (2) has passed all the way through said sleeve-forming tube (15), completing the stack inside the package (23), triggers the activation of the thermal clamps (21) used to make a closing transverse weld (22) across the top side of the wrapping of each package (23) and of the corresponding bottom side (17) of the wrapping of the next package (23) and then the activation of the cutting means (24) that separate the formed packages (23) from each other.

Underneath the intake box (28) and aligned with it over the opposing side of support (8) is the sleeve-forming tube (15) surrounded by the sleeve-shaping shoulder (14), forming the structure composing the sleeve-shaping chamber (13).

To this shaping chamber (13) is sent the polyethylene film (10) which, coming from a reel (40) that revolves around a lower axis and through guiding rollers, is inserted between a rotary mobile pressing jaw mounted on an articulated arm and a rotary pressing jaw mounted on the end of a fixed arm.

Between them, the two pressing jaws constitute a braking gripper for the film (10) which keeps the film tightly held over the shaping shoulder on which it ascends, after which it descends onto the rigid sleeve-forming tube (15).

Underneath the aforementioned rigid conduit is a system of horizontal welding means which consists of welding clamp-bearing bars for welding and cutting, which, in order to permit their horizontal opening and closing motion, are affixed to the respective walls which are perforated for that reason. In addition, said system of pressing arms is optionally completed with two facing blower nozzles which, as the sleeve (16) passes through the area adjacent to the welded bottom side (17), form the lateral gussets (26) designed to permit the formation of a flat base.

Both the clamp and the countercdamp are parts preferentially made of bronze and formed into a "U" shape, cooled by circulation of air and facing each other at their free branches which end in the elastic supports, preferentially of synthetic temperature-resistant rubber, and the rigid anti-slip counter-supports, the purpose of which is to keep the polyethylene film (10) firm during welding and cutting.

Inside each "U" there is a sliding steel part on which is mounted at least one welding strip or else two, preferentially made of Nichrome, which are responsible for making a single weld or else two, a lower and an upper weld, across the wrapping, and the system also has, in the central mid area, a cutting blade with a special edge, which is inserted in a facing recess, and which is responsible for separating the formed packages (23) from each other, by making a cut in the strip resulting from a single welding or in the space between consecutive welded seams. The aforementioned welding strips are rigidly held at one end over an insulated top, while from the other end they are taken by a sliding top with springs which maintains the tension of the strip and prevent its slackening, at the same time that it compensates for its stretching when heated.

The welding strips in any of its embodiments are coated with a layer of Teflon to prevent the polyethylene from sticking during sealing.

It should be noted that the sliding movement of this part is achieved through a horizontal sealing cylinder (37) whose shaft on the left pressing jaw pushes the part which carries the blade in order to carry out the sealing and cutting of the polyethylene.

Additionally, at least one of these pressing jaws may include a regulating screw for adjusting the closing of the welding and cutting jaws to ensure the perfect operation of the sets.

This entire system is moved with alternating horizontal movements of its jaws for the closing weld or the release opening, as the case may be.

In summary, the horizontal welding means (18) comprise a set of thermal clamps (21) used to seal a strip of closing transverse welding (22) of the top side of the wrapping of each package (23) and of the corresponding bottom side (17) of the wrapping of the next package (23) with a cutting means (24) to separate the formed packages (23) from each other in the middle of the strip, or else said horizontal welding means (18) comprise two sets of thermal clamps (21), the lower one used to make the transverse closing welding (22) of the top side of the wrapping of each package (23) and the upper one used to make the transverse closing welding (22) of the corresponding bottom side (17) of the wrapping of the next package (23) with a cutting means (24) to separate the formed packages (123) from each other in the empty space that exists between the two welds.

For the purpose of compactly closing the package (23) with a preset number of bags (2), said package having been formed by means of the described machine (1), it must be taken into account that when the loading of the bags (2) into the sleeve (16) is completed, an area of horizontal sealing is determined at the midpoint of a distance between the lower edge of the sleeve-forming tube (15) and the upper surface of the last bag, which must be equal to the distance between the center of the package (23) and the side of the sleeve (16) upon which the thermal clamps (21) make a closing transverse weld (22) on the top side of the wrapping of each package (23) and on the bottom side (17) corresponding to the wrapping of the next package (23).

The sensors of the machine (1) can be calibrated so that the synchronized means of conveyance (4) feed bags (2) to the support (8) in such a way as to form stacks of at least two bags (2) said stacks first being horizontally pushed, causing its movement toward the adjacent opening (30) of the sleeve-forming tube (15) and then vertically pushed, causing the descent of the whole arrangement, bags and wrapping, until the package (23) is completed, stacking in its interior a preset number of bags (2) wrapped in the sleeve (16).

Figure 2:
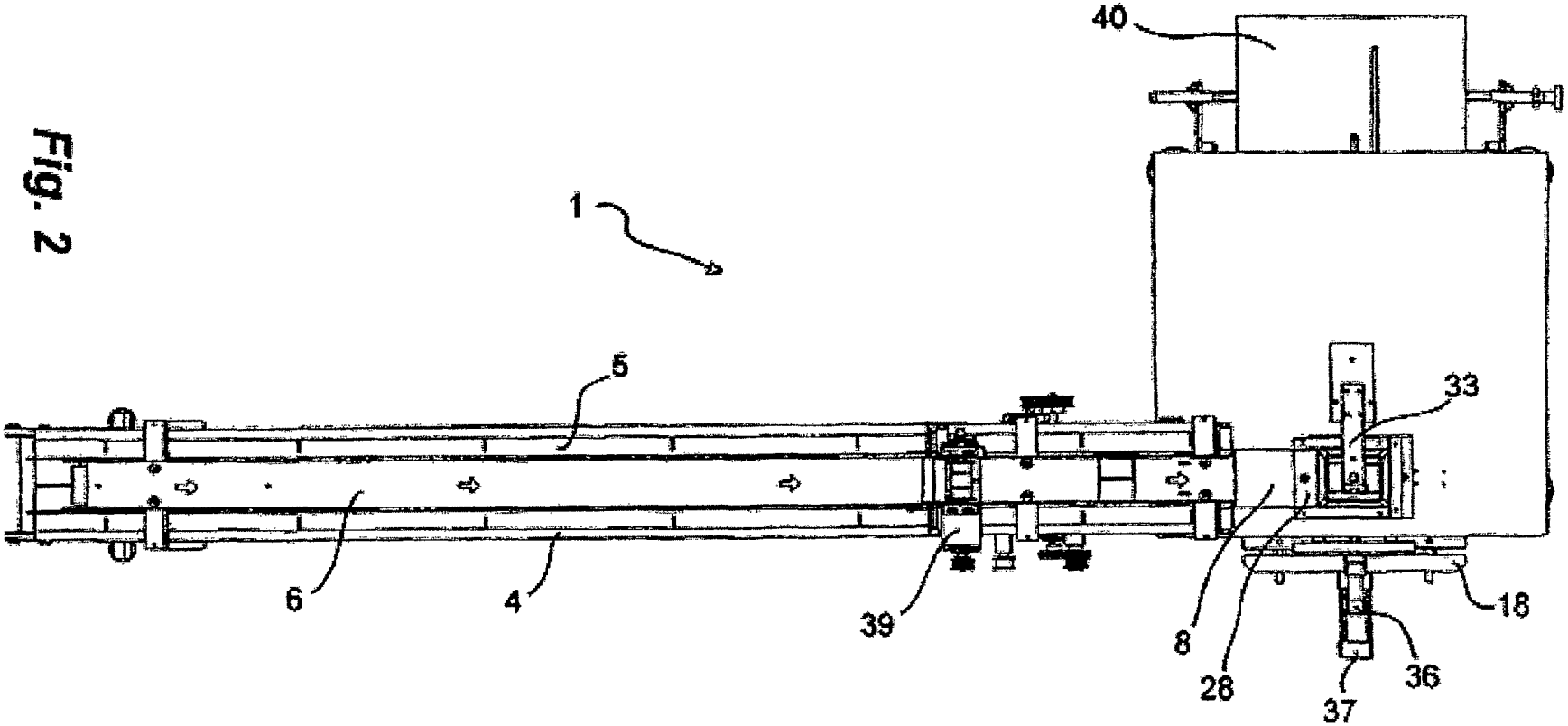
FIG. 2 is a top plan view of the preferred embodiment of the machine depicted in FIG. 1, showing the upper transfer belt of the individual packets, the floor of the intake box of the bag feeder with the vertically-acting pushing means mounted on the top of the machine that push the bags into the package causing the advance of the sleeve and the feeding reel of the plastic film used to make the wrapping sleeve of the bundle or package.
Figure 3:
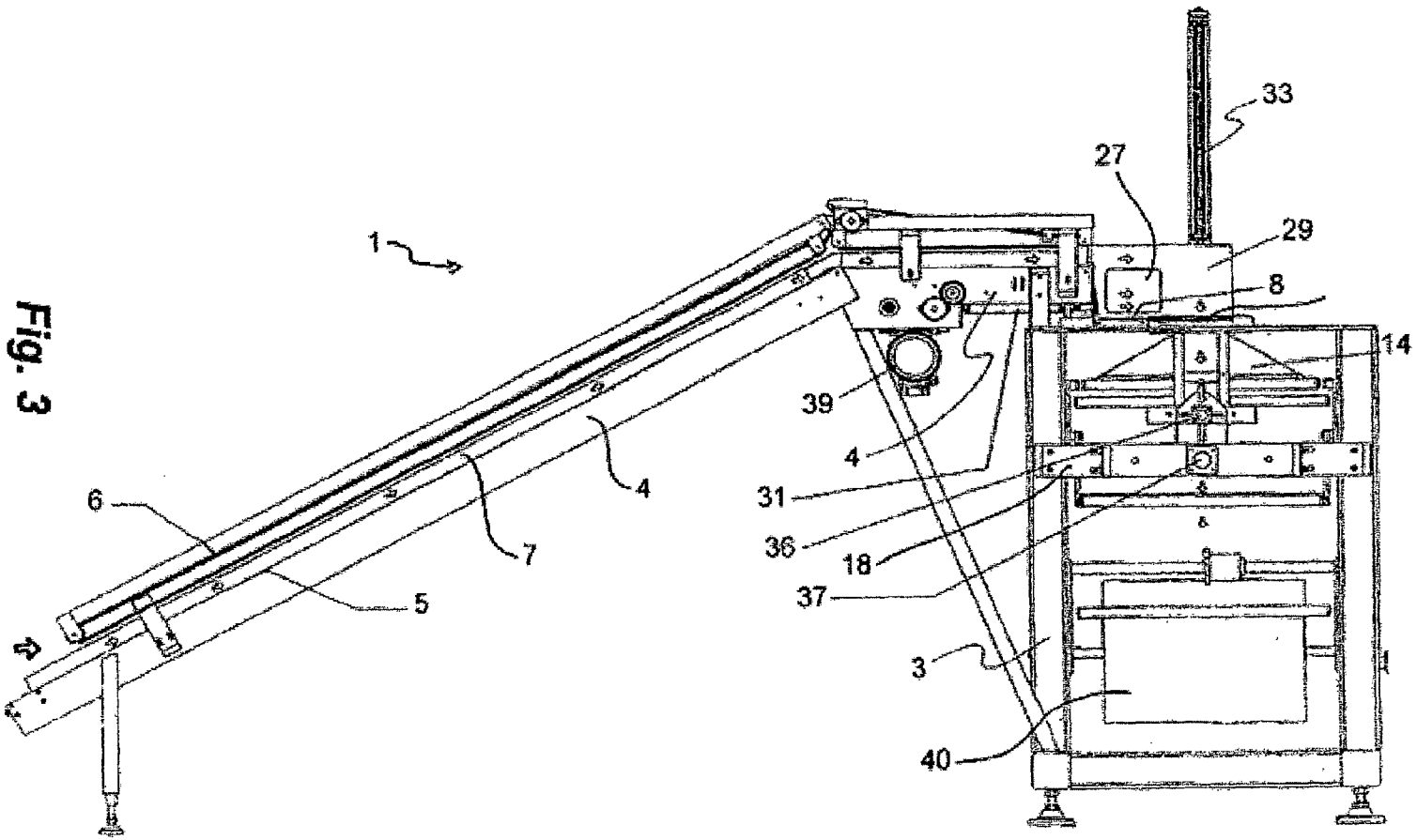
FIG. 3 is a front view of a preferred embodiment of the machine depicted in FIG. 1, showing in detail the conveyor belt and the upper belt for lifting and transferring the individual packets, the horizontal conveyor belt with its upper transfer belt, the sleeve-forming chamber, clamps for vertical and horizontal welding, a detail of the intake box of the bags to be bundled, horizontally-acting transfer means that push the bags from the support to the opening of the sleeve-forming tube, vertically-acting means that push the bags into the package by applying traction to the sleeve in formation and the reel of laminar material used to form the sleeve, all mounted on a support frame
Figure 4:
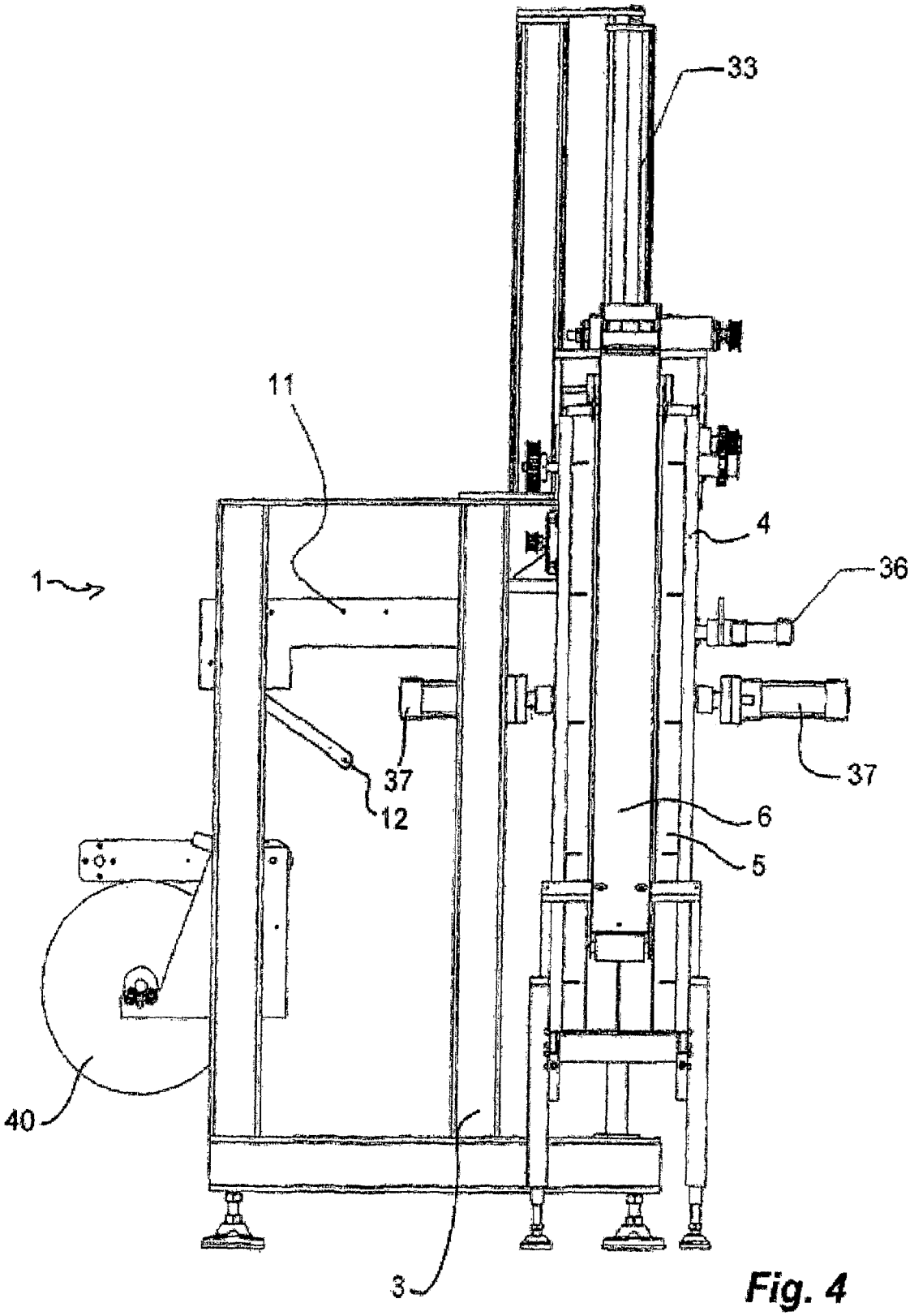
FIG. 4 is a side view of the machine depicted in FIG. 1 in which can be seen the sloping conveyor belt with its upper transferring belt, vertically-acting means that push the bags into the package by applying traction onto the sleeve in formation, making it advance by pushing the bags into the package through the sleeve-forming tube, the cylinder of vertical welding, the two cylinders of horizontal welding opposite each other, and the reel of laminar material mounted on the corresponding reel holder, all mounted on the same frame.
Figure 5:
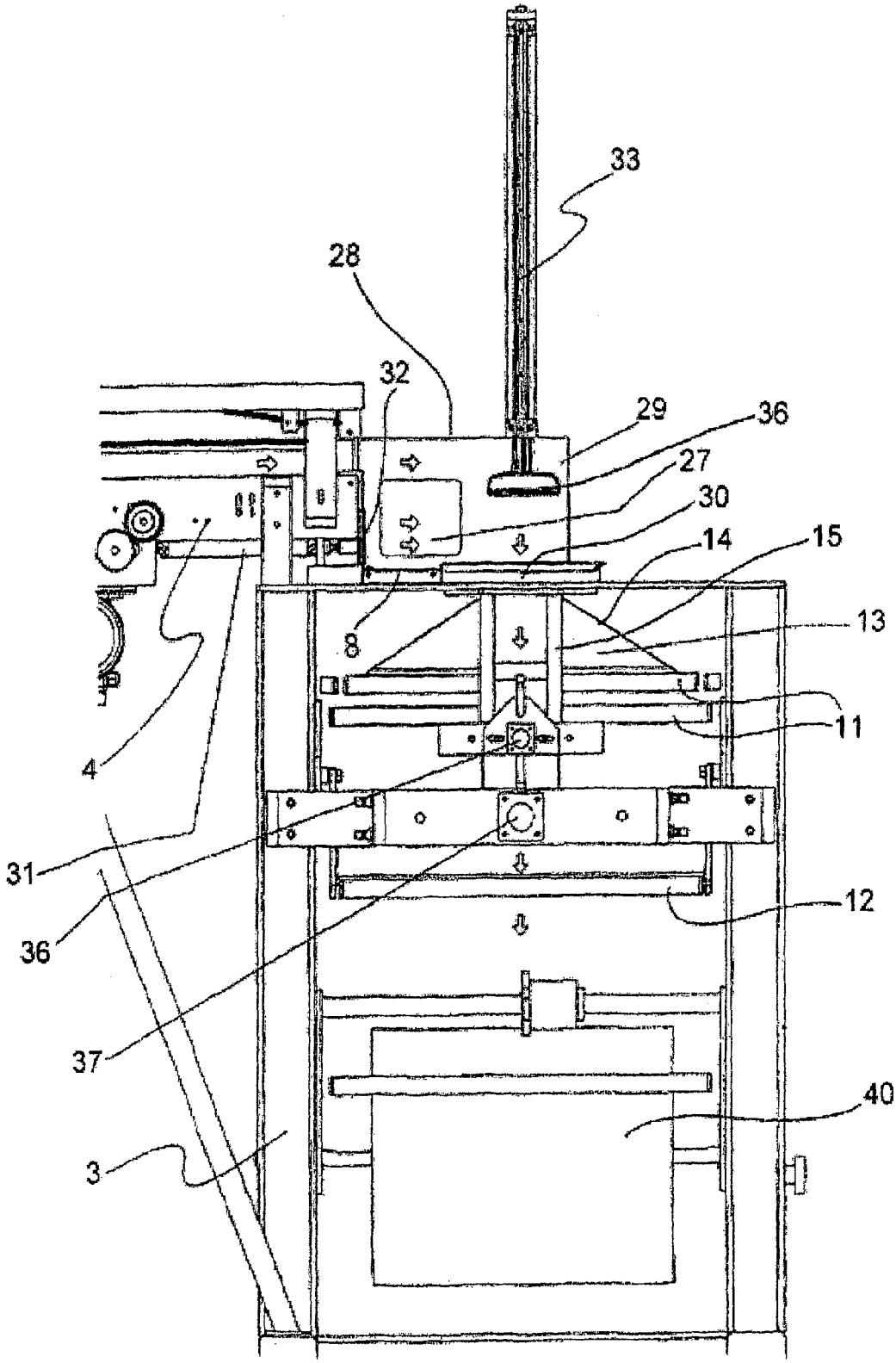
FIG. 5 shows a detail of the intake box, the entry of the bags onto its support, with the horizontally-acting means and the vertically-acting means, the sleeve-shaping chamber, and the vertical and horizontal welding clamps
Figure 7:
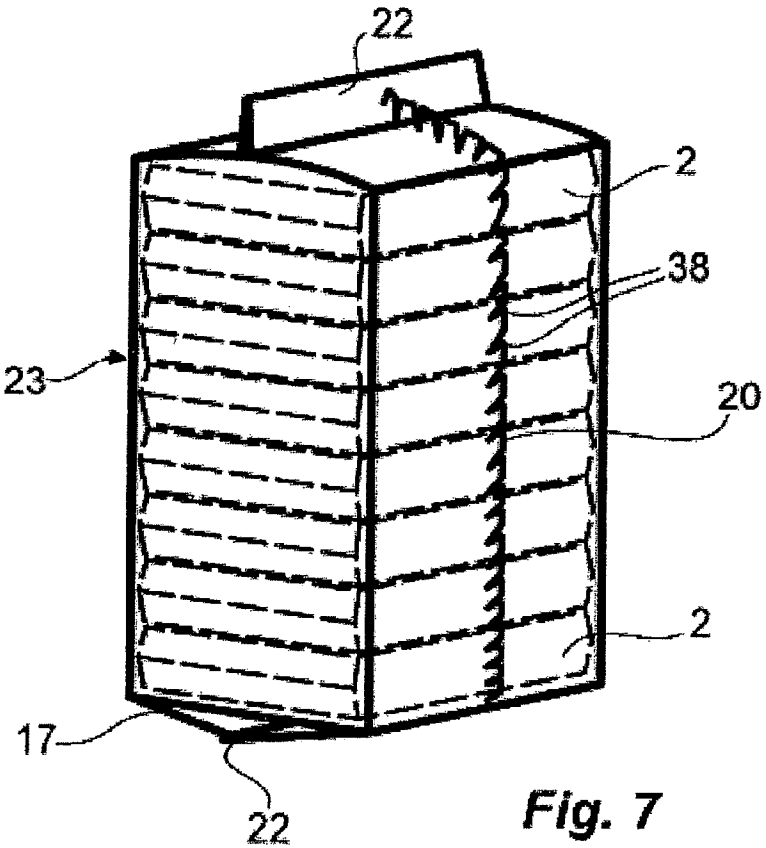
FIG. 7 shows a compact package obtained according to the method of the present invention, which has no empty spaces in its interior, using the machine depicted in FIGS. 1-5.
Figure 6:
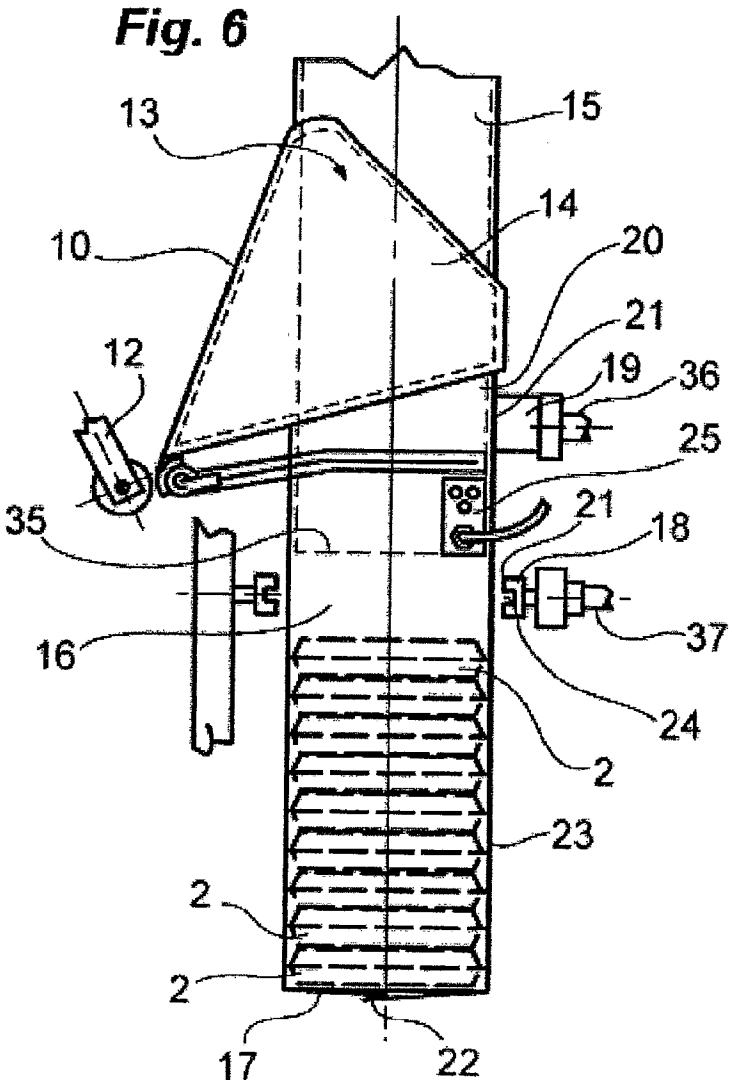
FIG. 6 is a schematic view of an instant during the formation of the package prior to its closure by welding, containing a predetermined number of bags, using the machine depicted in FIG. 1-5.

The Machine of FIGS. 1-5 Operates in the Following Way:

When the conveyor moves forward, the bags are forced to go through a passageway demarcated by the lower first belt and the upper second belt for lifting and transferring said bags. Optionally, the arms of a side-flattening device can smooth out the sides and top folds of the bags according to their content.

Previously, the sleeve has been closed at its bottom wall with welding seams, and the set of welding clamps supports the package while at the same time the cutting means separate it from the bottom of the next formed package.

The first bag enters into the cavity of the intake box and is deposited on the interior support. Eventually and optionally, at least one second bag enters into the same cavity of the box and stacks up on top of the previous bag. Said bag or the last bag of the stack formed on the support of the box enables a sensor that causes the horizontally-acting cylinder to push the bag or stack of bags towards the inlet opening of the sleeve-forming tube and become supported on the edge of said tube.

It is then that, by synchronized action with the horizontally-acting cylinder or by the action of another sensor properly located, such as for example an electric eye, the vertical pushing means are put into motion by means of a plate affixed to its end, which accompanies the bags in their descent through the sleeve-forming tube, until they reach the closed bottom of the wrapping or stack up on the bags that are already inside the package.

Only by action of the vertical push of the bags do the bags and the sleeve that envelops them jointly descend, a circumstance under which the vertical welder produces the first oblique transverse seams along the length of the overlapping edges. An intermediate sensor functions with the shadow of the bags; when the bags pass, a count is triggered which, when it reaches the preset number of bags, triggers the closing weld of the package and the formation of the bottom side of the next package.

When the area of the means of support inside the intake box empties, the next bag enters the intake box; in this case and in those that follow, the successive bags are being pushed toward the opening of the sleeve-forming tube and then vertically pushed individually or in stacks of at least two bags each to the wrapping bottom.

The horizontal welding means work only horizontally and the clamps are kept closed until the first bag or first group of bags reaches the bottom of the package, thus allowing the sealing to be completed effectively, after which they open so that the next vertical push can drag the sleeve of the package being formed, which contains the bags already introduced.

The vertical pushing of two or more stacked bags toward the sleeve accelerates the packaging process. This can be defined by an appropriate programming of the machine, obtaining velocities and quantities of bags per package according to what is convenient for each product or packaging situation.

Only by action of the vertical push given to the bags is the descent of the bags and their enveloping sleeve produced, a circumstance under which the vertical welder makes the first oblique transverse seams along the length of the overlapping edges. An intermediate sensor works with the shadow of the bags: when the bags pass they trigger a count that when it reaches the preset number of bags, triggers the closing weld of the package and the formation of the bottom side of the next package.

The process is thus repeated until the package is completed, leaving a final length of wrapping with a neck long enough to permit making the closure with at least one horizontal welding of the package, or else two welds, one on the laminar top side with which the resulting package is closed and another carried out on the bottom side, with which said bottom side is closed, leaving it ready to reinitiate the steps described, while at the same time, the cutting blade makes a cut at the intermediate area of the single weld or between the two seams in the second embodiment, which separates the package, leaving the formed package on an exit belt and ready to be loaded or handled as the case may be.

For the purpose of compactly closing the package with a preset number of bags, when the loading of the bags into the sleeve is completed, an area of horizontal sealing is determined at the midpoint of a distance between the lower edge of the sleeve-forming tube and the upper surface of the last bag, which must be equal to the distance between the center of the package and the side of the sleeve upon which the thermal clamps make a transverse weld to close the top side of the wrapping of each package and the corresponding bottom side of the wrapping of the next package.

Method for Wrapping Snack-Filled Bags Together

In a third aspect according to this invention, a method is proposed for wrapping filled bags together, wherein the bags are filled with a snack product in any of its forms, with the bags intended to be packed one on top of another, forming a stack which fits inside an elongated thermo-adhesive plastic laminar wrapping, joined along its longitudinal edges to form a sleeve closed at its bottom and at its top laminar side by means of welding seams at each place; said method comprises the following steps:

a) advancing the flat-lying snack-filled bags along a conveyor toward a vertical-lifting elevator wheel;
b) elevating the bags and pushing them individually toward a horizontal conveyor comprising a lower first belt and an upper second belt, that carries the bags to an opening of a sleeve-forming tube located above the bottom of an elongated laminar wrapping, giving the welding means time to close said bottom side with a transverse welding seam;
c) partially shaping over the sleeve-forming tube a continuous laminar wrapping longitudinally closed by welding in the shape of a sleeve with its bottom side welded according to step b) for the bags;
d) placing at least one or more stacked bags over the opening of the sleeve-forming tube;
e) pushing downward to cause the joint descent of the first bags and wrapping, at the same time that the sleeve is closed with longitudinal seams on one of its sides while the sleeve is descending with the bags in its interior;
f) continuing to feed bags in which at least one or more stacked bags are placed over the opening of the sleeve-forming tube and then pushing downward to cause the descent of the arrangement a number of times until the package is completed by stacking a predetermined number of bags inside the sleeve; and
g) closing of the laminar top side of the package shaped by the sleeve once it is complete, by means of a transverse weld, and separation of the formed package by means of a cut in such a way that at the same time, the bottom of the wrapping of the next package is formed.

The bags that are at a given height over a supporting rung of the vertical-lifting elevator wheel are pushed by horizontally-acting pushing means towards the opening of the adjacent sleeve-forming tube. Preferentially, the horizontal pushing means can be a pneumatic or hydraulic cylinder.

The lifting of the bags by a vertical-lifting elevator wheel allows for the cooling of the thermal sealing of the individual bags, making them more resistant to breakage by pressure during packaging.

Preferentially, the bags remain on the mouth of the sleeve-forming tube held up on means of support on the edge of said opening.

Preferentially, the inlet opening to the sleeve-forming tube comprises means of support for the bags which may be of different kinds and different construction designs. Preferentially, the means of support are outward-opening mouth flaps arranged in parallel on two opposite sides of the opening of the pre-former/sleeve-forming tube. In this way, the bag(s) are transferred through the last stretch of the lower first belt of the horizontal conveyance means to the mouth of the pre-former/sleeve-forming tube and the flaps of the means of support provide temporary support. When the bag or bags receive the vertical push to enter the sleeve, they undergo a lateral deformation such that the corners of the bag(s) are forced to bend, folding back onto said lateral sides by action of the pre-former.

Other construction alternatives may also be employed, as for example the use of free-spinning rollers instead of the fins described in the mouth of the pre-former/sleeve-forming tube or elastic flaps placed on the edge of the opening of the sleeve-forming tube or also combinations of the above.

More specifically, said means of support are used for the temporary accumulation of at least one bag, and are mounted over the opening of the vertical sleeve-forming tube which is an extension of a forming shoulder, both tube and shoulder being constituent elements of a sleeve-forming chamber. The forming shoulder surrounds the sleeve and is responsible for bending the elongated thermo-adhesive plastic laminar wrapping into the shape of a sleeve over the sleeve-forming tube over which the sleeve is longitudinally sealed.

Also preferentially, the opening of the sleeve-forming tube comprises a pre-former which forces the folding of the corners of the individual snack packets over their sides as they pass through it, to prevent tearing of the sleeve by the extended corners and to facilitate the close packaging of the bags in the sleeve.

The successive descent of the package comprising the bags and their wrapping is caused by the action of vertical pushing means which cause a plate to press down on the bags supported on the edge of the opening of the sleeve-forming tube while the bags are being forced into said wrapping at intervals determined by the introduction of each consecutive at least one bag.

Furthermore, the vertically-acting means of pushing are responsible for forcing the bags that were previously pushed horizontally from the vertical-lifting elevator wheel to the opening of the sleeve-forming tube, now pushing them down inside the sleeve that is being formed as the sleeve is being filled, thus preventing the bags from being left loose in the interior of the package and causing the joint descent of the bags and sleeve. Preferentially, the vertically-acting means may be a servomechanism driven by sensors and run stoppers that take it from one position to another and sequentially define the position and run to adopt according to the package-filling stage.

The longitudinal seams created on the laminar material on one of its sides to shape the wrapping sleeve can be discontinuous, that is to say, a series of short parallel welds side by side in such a way that they give the appearance and produce the effect of a continuous weld. These seams are made during the descent of the sleeve with the bags contained inside, pushed by the vertical means of action. Said discontinuous seams can be oblique to the longitudinal edges of the film to facilitate the task during the descent of the whole package.

Thus, very compact packages result, formed by the sleeve obtained from the laminar material wrapped around the stack of filled bags, which is closed on its upper and lower surfaces by the respective transverse and longitudinal seams. During the whole process, the sleeve is closed by the joining of its overlapping longitudinal edges by the aforementioned longitudinally-made seams.

Preferentially, the closing by welding of the wrapping bottom is made together by a blowing against two of the opposite lateral walls of said wrapping, thus creating the gradual formation of each longitudinal gusset.

When the closing top weld of the completed package of bags is made, at the same time the closing bottom weld of the immediately following package is accomplished, and then a cut is made to separate the closed package, while the bottom wrapping of the next package is already formed.

In turn, the transverse closing weld of step g) may be either a welding strip cut along its middle, or else the transverse closing weld of step g) may be double, with the cut made in the empty space remaining between the two welds.

For the purpose of compactly closing the package with a predetermined number of bags using the transverse closing weld of step g), when the loading of bags into the sleeve is completed there must be a horizontal sealing area at the midpoint of the distance between the lower edge of the sleeve-forming tube and the upper surface of the last bag, said distance being equal to the distance between the center of the package and the side of the sleeve on which is made the transverse closing weld for the top side of the package wrapping, and the bottom corresponding to the wrapping of the next package.

Step d) of the method for wrapping snack-filled bags together may optionally comprise the delivery of at least a second bag to the opening of the sleeve-forming tube in such a way that it stacks on top of the preceding one.

Step f) of the method for wrapping snack-filled bags together optionally comprises the feeding of bags to the opening of the sleeve-forming tube in such a way as to form stacks of at least two or more bags, then to push them vertically through the sleeve-forming tube, causing the joint descent of the bags and sleeve until the package is completed by stacking in its interior a predetermined number of bags wrapped by the sleeve.

Machine for Wrapping Snack-Filled Bags Applicable to the Method Previously Described In a fourth aspect of the present invention, a machine (101) is also provided for the wrapping of bags (102) containing snacks, applicable to the method previously described, which, mounted on a vertical truss (103), comprises:

synchronized interlinked means of conveyance (104) which comprise: a horizontal conveyor belt (105), a vertical-lifting elevator wheel (106) and a set of horizontal means of conveyance (107) that comprise a lower first belt (107') and an upper second belt (107") arranged in different overlapping and parallel planes such that a passageway (108) is formed between them for the bags (102) to advance toward an opening of a sleeve-forming tube (115);

a feeder (109) of laminar thermo-adhesive plastic film (110) which, with corresponding guiding rollers (111) and tightening members (112), feeds into a chamber (113) that shapes the wrapping sleeve for the bags stacked one on top of another, where said chamber (113) comprises a shoulder (114) and a sleeve-forming tube (115), with this sleeve (116) being partially formed starting from a transverse welded bottom seam which creates its bottom side (117);

horizontal welding means (118) at the bottom (117) and top of the wrapping, as well as vertical welding means (119) used to join the overlapping longitudinal edges (120) of the laminar wrapping (110), with the horizontal welding means (118) being located below the outlet (135) of the sleeve-forming tube (115) and comprising thermal clamps (121) used to form a transverse closing weld (122) for the top side of the wrapping of each package (123) and the corresponding bottom side (117) of the next package (123), with a means of cutting (124) to separate the formed packages (123) from each other, with said horizontal welding means (110) to include means of blowing (125) which make a gusset (126) for the sleeve (116), while the vertical welding means (119) are formed by a set of thermal clamps (121) located on a plane below that of the opening (130) of the sleeve-forming tube (115) and above said tube (115), coinciding with the line of overlap between the longitudinal edges (120) of the wrapping; said machine (101) also comprises:

means of horizontal pushing (131) that act upon a movably mounted plate (132) which pushes the individual bags (102) from their position on the vertical-lifting elevator wheel (106) toward the horizontal means of conveyance (107);

an intake box (128) for bags (102) formed by an enclosure (129) that internally comprises an inlet opening (130) to the sleeve-forming tube (115) for the bags (102) that are delivered by the horizontal conveyor means (107);

vertically-acting means of pushing (133) located above said intake box (128) the axis of action of which is collinear with the axis of the sleeve-forming tube (115) that is located below it, wherein said vertically-acting means of pushing (133) comprise at their end a plate (134) and when activated presses on at least one bag (102) supported above the opening (130) of the sleeve-forming tube (115), pushing the formed sleeve (116) and its contents through the outlet (135) of the sleeve-forming tube (115) toward the horizontal welding means (118); and an exit belt (148) located in front of and below the sleeve-forming tube (115) to transport the formed packages.

Preferentially, the inlet opening (130) to the sleeve-forming tube (115) comprises means of support (141) for the bags (115) that may be of different types and have different construction designs. Preferentially, the means of support (141) are outward-opening flaps (141') placed parallel at the two facing sides of the opening of the pre-former (142)/sleeve-forming tube (115). In this way, the bag(s) (102) are transferred for the last stretch of the lower first belt (107') of the horizontal means of conveyance (107) to the mouth of the pre-former (142)/sleeve-forming tube (115) and the flaps (141') of the means of support (141) provide a temporary support. When the bag or bags (102) receive the vertical push to be introduced into the sleeve (116), they undergo a lateral deformation such that the corners (147) of the bag(s) are turned down, folding them in along said laterals by action of the pre-former (142).

Other construction alternatives can also be used, as for example providing free-spinning rollers instead of the fins described at the mouth of the pre-former (142)/sleeve-forming tube (115) or elastic flaps located on the edge of the opening (130) of the sleeve-forming tube (115), or also combinations of the above.

More specifically, said support means (141) are used for the temporary collection of the at least one bag (102) and are mounted over the opening (130) of the vertical tube (115) which shapes the sleeve (116) that is an extension of a shaping shoulder (114), both of which, tube (115) and shoulder (114), are constituent elements of a chamber (113) for the shaping of the sleeve (116). The shaping shoulder envelops the sleeve-forming tube (115) and is responsible for folding the elongated thermo-adhesive laminar plastic wrapping into the form of a sleeve (116) over the sleeve-forming tube (115) over which the sleeve (116) is sealed longitudinally.

Also preferentially, the opening (130) of the sleeve-forming tube (115) comprises a pre-former (142) which forces the folding down of the corners (147) of the individual snack-filled bags (102) along their lateral sides as they pass through it, to avoid tears of the sleeve by the extended corners and to facilitate the close packaging of the bags (102) in the sleeve (116).

Said pre-former (142) comprises two opposing elements (143), folded over the corners (144) of the sleeve-forming tube (115) and the ends of which (145) are fixed to the center of two lateral faces (146) opposite said tube (115), in such a way that these elements (143) present an oblique extension which direct and fold the corners (147) of the bags (102) folding them in along their sides.

This machine (101) permits receiving the bags (102) onto the means of support (141) at the opening (130) of the sleeve-forming tube (115) located in an intake box (128), and the bags are pushed vertically through the opening (130) of the sleeve-forming tube (115), which is inside the sleeve (116) being formed, creating this push with ad hoc mechanical means that cause the sleeve (116) being formed to advance, thus accelerating the packaging time and preventing empty spaces from remaining inside the package (123), which would interfere with its stability.

The machine (101) comprises a vertical truss (103) or frame which contains on its top and sides a horizontally-acting means of pushing (131) that moves the snack-filled bags (102) from their raised position on the vertical-lifting elevator wheel (106), delivering them to the set of horizontal means of conveyance (107) which deposits them onto the means of support (141) at the opening (130) of the sleeve-forming tube (115) in the intake box (128) by accumulation.

Simultaneously, at the lower levels aligned with the intake box (128) is mounted a sleeve-shaping chamber (113) comprising the shaping shoulder (114) and the sleeve-forming tube (115), the vertical welding means (119) and horizontal welding means (118), and the reel (140) with the whole feeder system (109) of the flat plastic wrapping film (110).

More specifically, the truss (103) is a body formed by two large upright columns resting on a base or legs which support the entire structure, and to which are affixed the rail bars that constitute the support of the clamp-bearing bars of the horizontal welding system (118) as well as the axis of the reel (140) carrying the plastic sheet (110), the guiding rollers, the sleeve-forming top, and the other mechanisms and devices, driven by one or more motors through gearboxes, motion transmitters, etc., which are not detailed here as they are not relevant to the purposes of the present invention and which can be implemented in many different ways which differ only in their construction.

The shaping tube (115) continues forming the sleeve (116) from a thermo-adhesive plastic material, preferentially polyethylene, which as it is being closed laterally, slides over the areas adjacent to the overlapping longitudinal edges (120) between the jaws of a system of vertical welding means (119) that produce oblique and discontinuous seams (138), each time that the sleeve (116) stops, and as far as it advances. The sliding movement of this part is achieved by means of a vertical sealing cylinder (136).

The means of conveyance (104) of the machine (101) according to the present invention comprise a horizontal conveyor belt (105) and a vertical-lifting elevator wheel (106) from which the horizontally-acting means of pushing (131) deliver the bags (102) to a set of horizontal conveyor means (107), which in turn deliver them onto means of support (141) located at the opening of the sleeve-forming tube (115) inside the intake box (128).

The horizontal conveyor belt (105), the vertical-lifting elevator wheel (106), and the lower first belt (107') and upper second belt (107") may all be of endless belt or strap type. The wheels of the upper belt (107") turn in the opposite direction from those of the lower belt (107'), producing a common direction of advance toward the means of support (141) at the opening (130) of the sleeve-forming tube (115) of the intake box (128). Preferentially, the conveyors are driven electromechanically by at least one electric motor with gearbox (139).

The distance that separates the two belts, lower (107') and upper (107"), of the set of horizontal conveyor means (107), is such that the bag fits between them to facilitate its movement.

Then, the bags (102) advance with uniform linear movement and arrive at the intake box (128) which comprises the means of support (141) located at the opening of the sleeve-forming tube (115) around which the sleeve (116) is formed.

This box consists of a frame or enclosure (129) with four erect walls demarcating a cavity which houses support means (141) in the opening of the sleeve-forming tube (115) that are compatible with the shape and size of each bag (102).

Preferentially, the front wall of the enclosure (129) may comprise an inspection window (127), which may preferentially be closed with a clear material such as, for example, an acrylic plate.

Also preferentially, the horizontally-acting means of pushing (131) comprise a horizontal pushing cylinder, preferentially pneumatic or hydraulic.

Still preferentially, the vertically-acting means of pushing (133) comprise a servomechanism, and the plate (134) of the vertically-acting means of pushing (133) is concave.

The wrapping machine (101) can then comprise an intake box (128) constituted by an enclosure (129) with rigid walls, of which the front wall optionally comprises an inspection window (127), that demarcate a space of a capacity compatible with the flat-lying bags (102) which enter it, wherein the upper part of said space is open, while in the lower part the support means (141) are located at the opening of the sleeve-forming tube (115) for the bags (102), which are then pushed, by means of a vertically-acting servomechanism (133), with an associated plate (134) on its lower end, through said sleeve-forming tube (115) and into the wrapping sleeve (116), wherein the aforementioned box is fed with bags (102) by the horizontal conveyor means (107), and wherein the plate (134) of the vertically-acting servomechanism (133) is activated in response to the transfer of at least one bag onto the support means (141) present in the opening (130) of the shaping tube (115) by a sensor, and the welding clamps are activated in response to another sensor which counts the bags (102) that pass through the sleeve-forming tube (115).

A detection sensor over the opening (130) of the sleeve-forming tube (115) is an electric eye that detects when at least one bag (102) has been placed over the opening (130) of the sleeve-forming tube (115), triggering the activation of the vertical pushing servomechanism to push said bag (102) through the mouth (130) of the sleeve-forming tube (115), causing the advance of the bags (102) and the sleeve (116) together.

A sensor in the sleeve-forming tube (115) is an electric eye which, by detecting when a predetermined number of bags (102) has passed all the way through said sleeve-forming tube (115), completing the stack inside the package (123), triggers the activation of the thermal clamps (121) used to make a closing transverse weld (122) across the top side of the wrapping of each package (123) and of the corresponding bottom side (117) of the wrapping of the next package (123) and then the activation of the cutting means (124) that separate the formed packages (123) from each other.

Underneath the intake box (128) and aligned with it is the sleeve-forming tube (115) surrounded by the sleeve-shaping shoulder (114), which together form the sleeve-shaping chamber (113).

In this shaping chamber (113) is housed the thermo-adhesive plastic sheet (110), preferentially polyethylene, which, coming from a reel that revolves around a lower axis (149) and across guiding rollers, is inserted between a rotary mobile jaw mounted on an articulated arm and a rotary jaw mounted on the end of a fixed arm.

Between them, the two jaws constitute a braking film gripper (110), which keep the film tightly over the shaping shoulder (114) into which it ascends, after which it descends onto the rigid sleeve-forming tube (115).

Underneath the aforementioned rigid conduit is a system of horizontal welding means (118) which consists of welding clamp-bearing bars for welding and cutting, which, in order to permit their horizontal opening and closing motion, are affixed to the respective walls that are perforated for that reason. In addition, said system of jaws is optionally completed with two opposing blower nozzles which, as the sleeve (116) passes in the area adjacent to the welded bottom side (117), form the lateral gussets (126) designed to permit the formation of a flat base.

Both the clamp and the countercdamp are parts preferentially made of bronze and formed into a "U" shape, cooled by circulation of air and facing each other at their free branches which end in the elastic supports, preferentially of synthetic temperature-resistant rubber, and the rigid anti-slip counter-supports, the purpose of which is to hold firm the plastic thermo-adhesive film (110), preferentially polyethylene, during welding and cutting.

Inside each "U" there is a sliding steel part on which is mounted at least one welding strip or else two, preferentially made of Nichrome, which are responsible for making a single weld or else two, a lower and an upper weld, across the wrapping, and the system also has, in the central intermediate area, a cutting blade with a special edge, which is inserted in a facing recess, and which is responsible for separating the formed packages (123) from each other, by making a cut in the strip resulting from a single welding or in the space between the consecutive welded seams. The aforementioned welding strips are rigidly held at one end over an insulated top, while from the other end they are taken by a sliding top with springs which maintains the tension of the strip and prevents its slackening, at the same time that it compensates for its stretching when heated.

The welding strips in any of the embodiments are coated with a layer of Teflon to avoid its sticking to the thermo-adhesive plastic during sealing.

It should be noted that the sliding movement of this part is achieved through a horizontal sealing cylinder (137) whose shaft on the left jaw pushes the part which carries the blade in order to carry out the sealing and cutting of the thermo-adhesive plastic or polyethylene.

Additionally, at least one of these jaws can include a regulating screw for adjusting the closing of the welding and cutting jaws to ensure the perfect operation of the sets.

This entire system is moved with alternating horizontal movements of its jaws for the closing weld or the releasing opening, as the case may be.

In summary, the horizontal welding means (118) comprise a set of thermal clamps (121) used to form a strip of closing transverse welding (122) of the top side of the wrapping of each package (123) and of the corresponding bottom side (117) of the wrapping of the next package (123) with a means of cutting (124) to separate the formed packages (123) from each other in the middle of the strip, or else said horizontal welding means (118) comprise two sets of thermal clamps (121), the lower one used to make the transverse closing weld (122) of the top side of the wrapping of each package (123) and the upper one used to make the transverse closing weld (122) of the corresponding bottom side (117) of the wrapping of the next package (123) with means of cutting (124) to separate the formed packages (123) from each other in the empty space that exists between the two welds.

For the purpose of compactly closing the package (123) with a predetermined number of bags (102), said package having been formed by means of the described machine (101 ), it must be taken into account that when the loading of the bags (102) into the sleeve (116) is completed, there must be a horizontal sealing area at the midpoint of a distance between the lower edge of the sleeve-forming tube (115) and the upper surface of the last bag, which must be equal to the distance between the center of the package (123) and the side of the sleeve (116) upon which the thermal clamps (121) make a closing transverse weld (122) on the top side of the wrapping of each package (123) and on the bottom side (117) corresponding to the wrapping of the next package (123).

The sensors of the machine (101) can be calibrated so that the synchronized means of conveyance (104) feed bags (102) into the intake box (128) onto the means of support (141) located at the opening of the sleeve-forming tube (115), in such a way as to deposit at least one bag (102) or form stacks of at least two bags (102), said bag or stack of bags being vertically pushed which causes the descent of the whole lot until the package (123) is completed, stacking in its interior a preset number of bags (102) wrapped in the sleeve (116).

Figure 8:
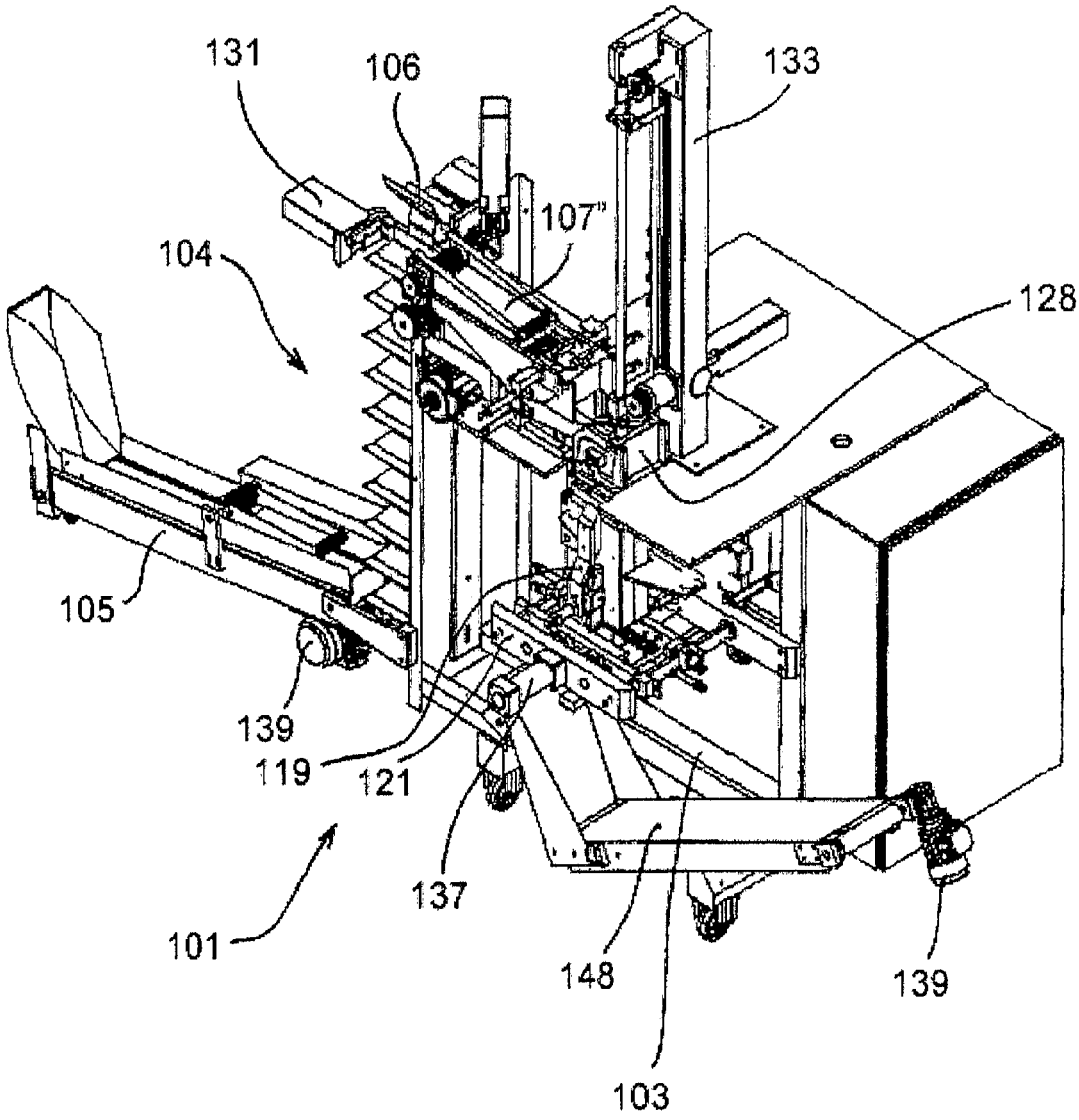
FIG. 8 is a front perspective view from above of a preferred embodiment of the machine for packaging snack-filled bags, subject of the present invention, showing its main parts: horizontal conveyor belt, a vertical-lifting elevator wheel and the set of horizontal conveying means; horizontal welding means for the bottom side and top side of the wrapping; vertical welding means for joining the edges of the wrapping film longitudinally; horizontally-acting pushing means; bag intake box; pushing means acting vertically through the sleeve-forming tube which are located above said intake box; and exit belt, all mounted on a supporting frame.
Figure 9:
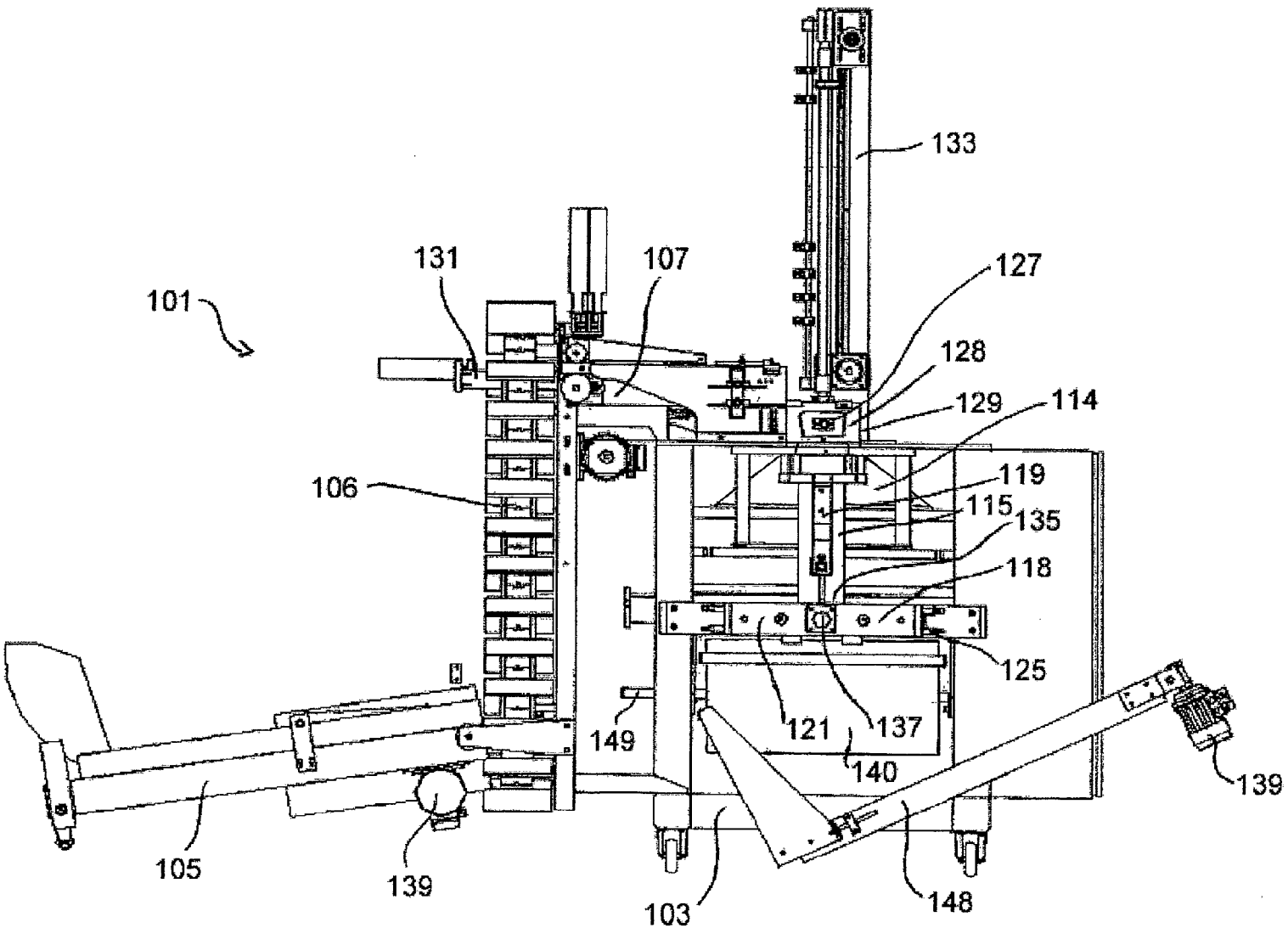
FIG. 9 is a front view of the preferred embodiment of the machine depicted in FIG. 8, showing in detail the horizontal conveyor belt, the vertical-lifting elevator wheel and the set of horizontal conveying means; the horizontal heat-sealing means of the bottom side and top side of the packages; the vertical welding means for joining the edges of the wrapping film longitudinally; horizontally-acting pushing means; bag intake box; pushing means acting vertically through the sleeve-forming tube which are located above said intake box; and exit belt, all mounted on a supporting frame.
Figure 10:
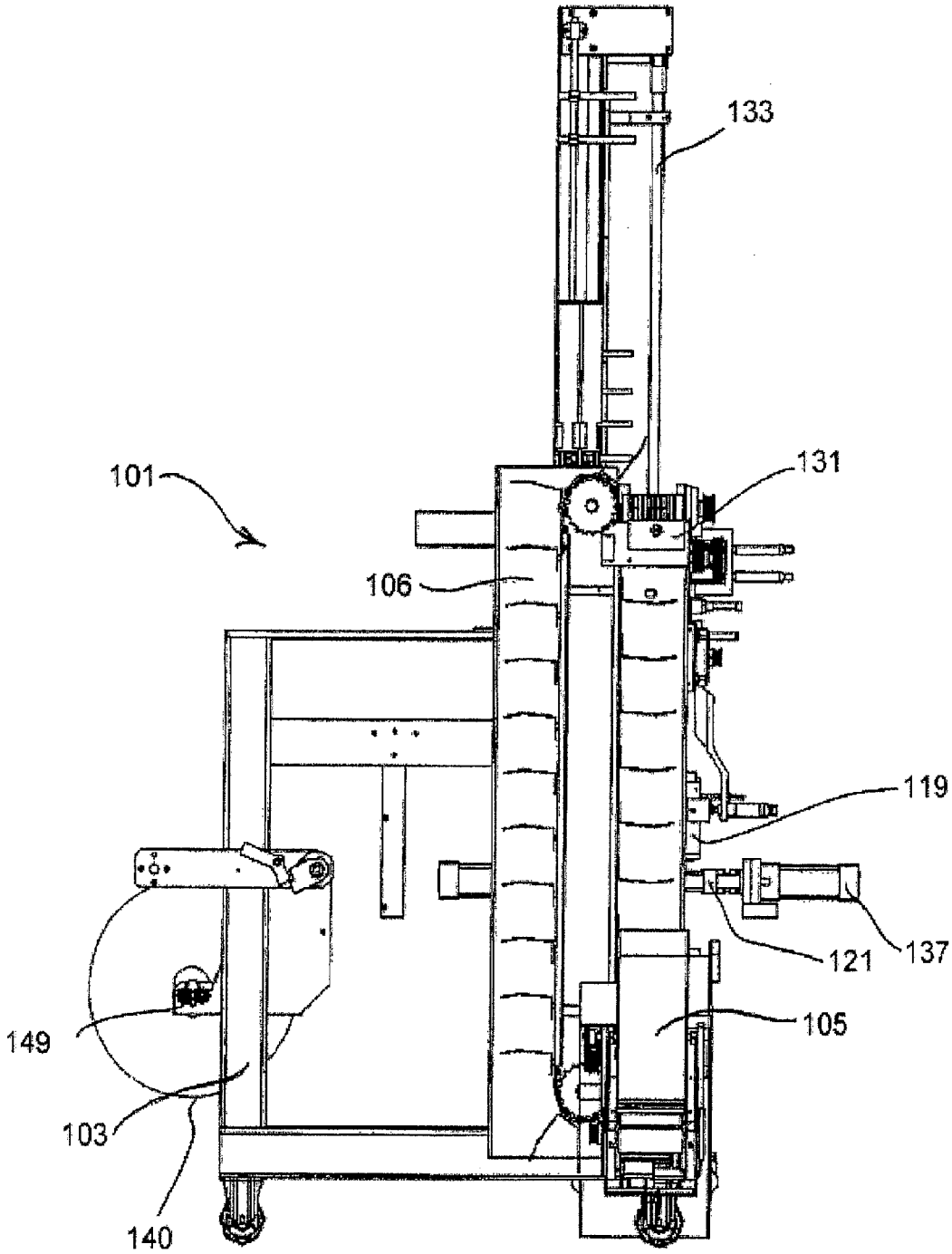
FIG. 10 is a right side view of the machine depicted in FIG. 8 in which can be seen: horizontal conveyor belt and vertical-lifting elevator wheel; vertically-acting pushing means; and the posterior frame where the axis of the reel of laminar material is located in the corresponding reel holder, all mounted on the same frame.
Figure 11:
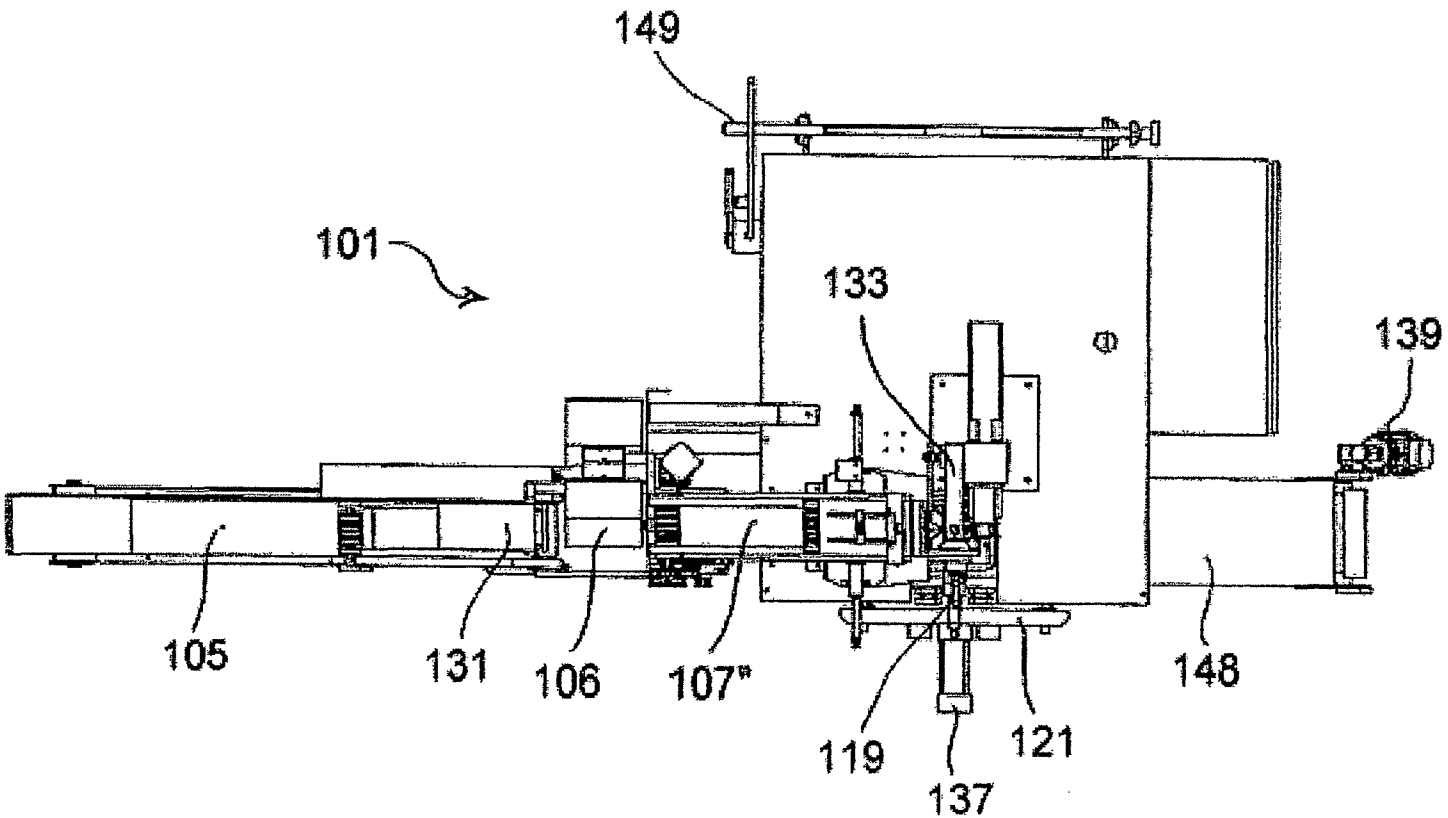
FIG. 11 is a top plan view of the machine depicted in FIG. 8, showing: horizontal conveyor belt, overhead view of the vertical-lifting elevator wheel; set of horizontal conveyor means; horizontally-acting pushing means; vertically-acting pushing means; and exit belt, all mounted on a supporting frame; and the posterior frame where the axis of the reel of laminar material is located in the corresponding reel holder, all mounted on the same frame.
Figure 12:
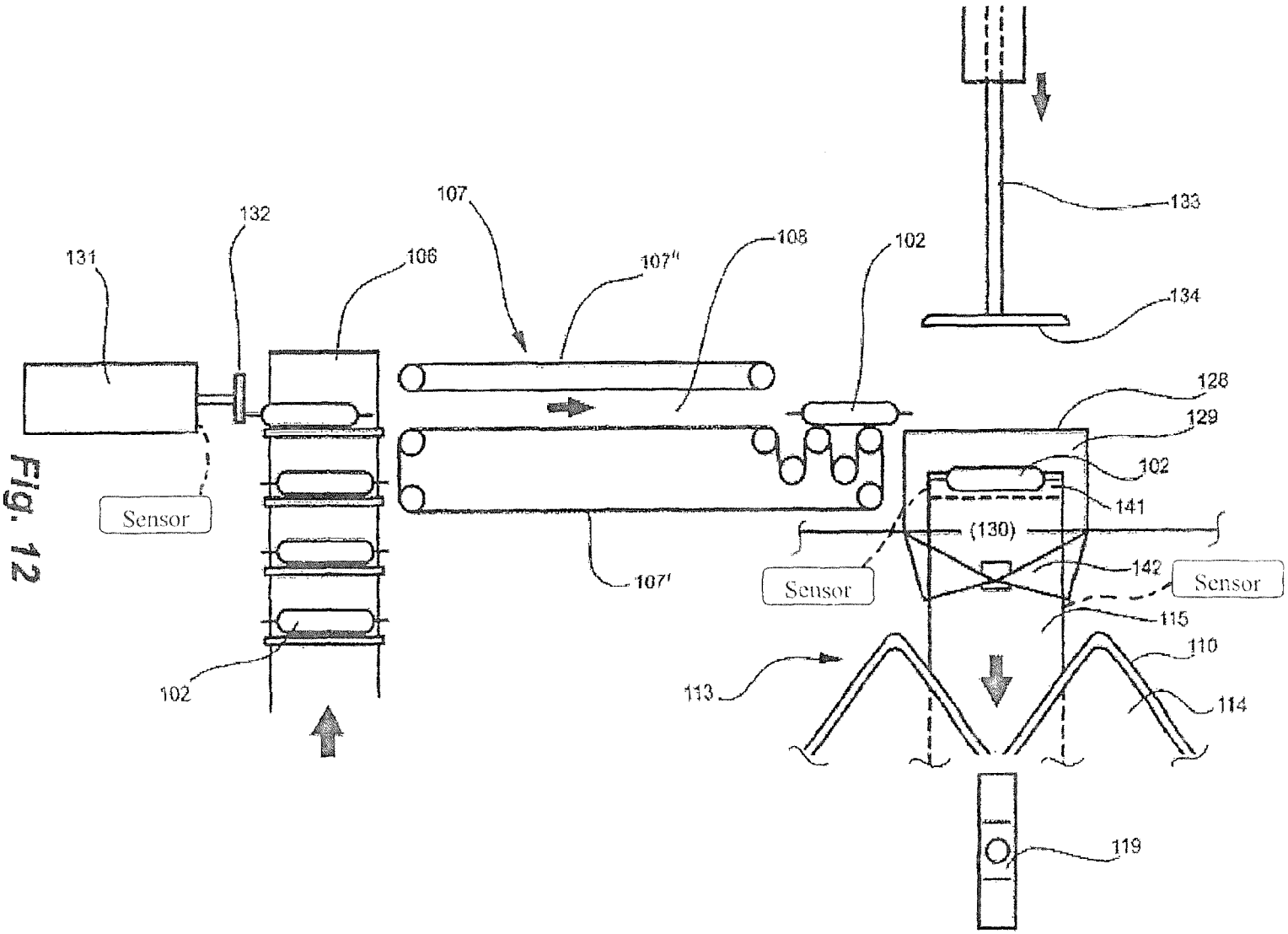
FIG. 12 is a schematic view of a preferred embodiment of the transport of the snack-filled bags from the vertical-lifting elevator wheel where they are pushed by horizontal pushing means toward the passageway existing between the upper and lower belts of the horizontal conveyor belts, and its location over the mouth of the entrance of the sleeve-forming tube under the vertical pushing mechanisms, as in the machine depicted in FIGS. 8-11.
Figure 14:
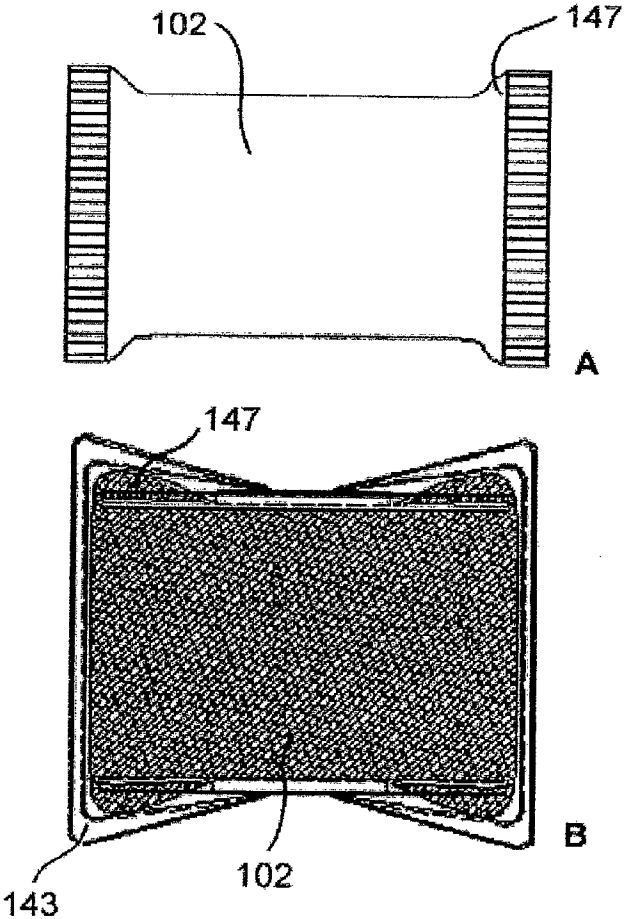
FIG. 14A shows a snack-filled bag before being packaged, with its corners unfolded.
FIG. 14B is the same bag crossing the pre-former, showing how the comers are folded in along its sides.
Figure 13:
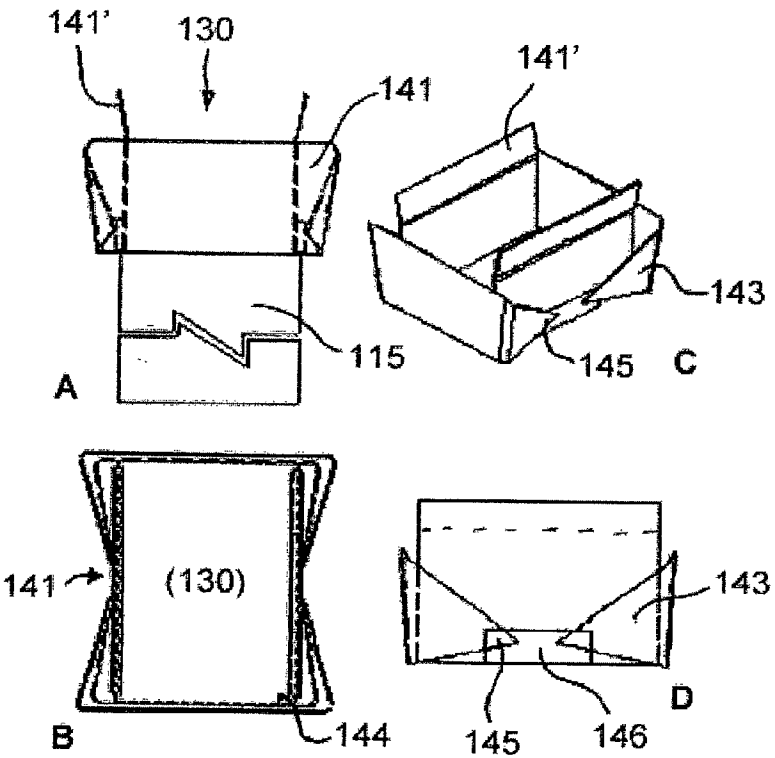
Figure 15:
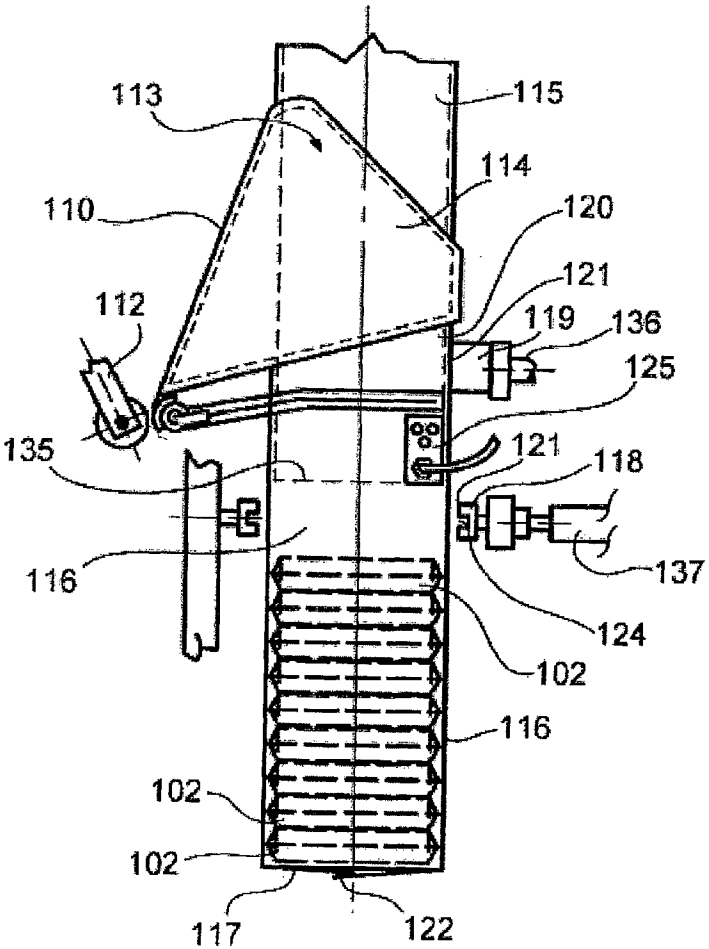
FIG. 15 is a schematic view of an instant during the formation of the package of snack bags prior to its closure by welding, containing a predetermined number of said bags, using the machine depicted in FIGS. 8-11.
Figure 16:
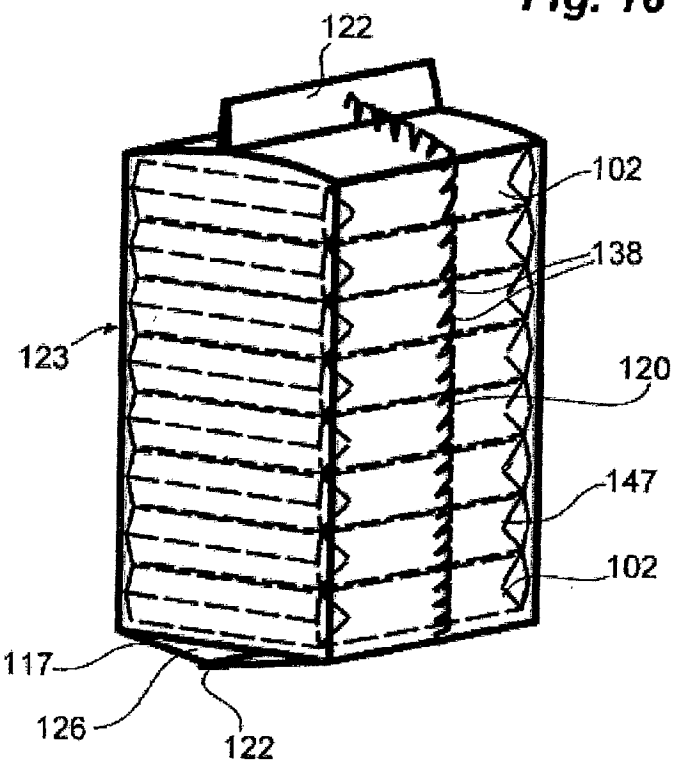
FIG. 16 shows a compact package of filled snack bags, obtained according to a preferred embodiment of the method of the present invention, which has no empty spaces in its interior, using the machine depicted in FIGS. 8-11.

The Machine of FIGS. 8-11 Operates as Follows:

As the snack-filled bags are emerging from the bagging machine, they fall onto the end of the horizontal conveyor belt that carries them to the vertical-lifting elevator wheel that raises them. At a certain height, horizontal pushing means push the bags toward a set of horizontal conveying means composed of two overlapping belts that transport the bags toward an intake box.

As the bags advance by means of the overlapping belts, they are forced to pass through a defined passageway between the lower first belt and the upper second belt.

Previously, the sleeve has been closed on its bottom surface with a welding seam, and the set of welding clamps sustain the package while at the same time the cutting means separate it from the bottom of the next package being formed.

The first bag enters the cavity of the intake box and is deposited onto the means of support in the opening of the sleeve-forming tube. Eventually and optionally, at least a second bag enters the same cavity of the box and is stacked on top of the previous one. The bag in question or the last bag of the stack that is formed upon the means of support, triggers an appropriately placed sensor, such as, for example, an electric eye, that sets into motion the vertically-acting pushing means which, using a plate affixed to its end, accompanies the bags in their descent through the sleeve-forming tube until they are packed against the closed bottom of the wrapping or on top of the bags that are already stacked inside the package.

The horizontal welding means only work horizontally and the clamps remain closed until the first bag or group of bags enter the bottom of the package, thus permitting the seal to be completed effectively, after which they open so that the next vertical push will drag the sleeve of the package being formed, containing the introduced bags.

The vertical pushing of two or more stacked bags toward the sleeve accelerates the packing process. This can be defined by means of an appropriate programming of the machine, thus obtaining packaging speeds and quantities of bags per package according to what is appropriate for each product or packing situation.

Only by action of the vertical push of the bags do the bags and the sleeve that envelops them jointly descend, this being the circumstance under which the vertical welder produces the first oblique transverse seams along the length of the overlapping edges. An intermediate sensor functions with the shadow of the bags; when the bags pass, a count is triggered which, when it reaches the preset number of bags, triggers the closing weld of the package and the formation of the bottom of the next package.

When the area above the means of support inside the intake box empties, the next bag enters the intake box; in this case and in those that follow, the successive bags are being vertically pushed individually or in stacks of at least two bags each, being retained by the bottom of the wrapping.

With the entry of each bag or stack of bags to become part of the package, the whole continues to descend a proportional distance, which descent is used to continue forming, with the vertical welder, the aforementioned seams of the longitudinal edges of the wrapping.

The process is thus repeated until the package is completed, leaving a final length of wrapping with a neck long enough to permit making the closure with at least one horizontal welding of the package, or else two welds, one on the laminar top sides with which the resulting package is closed and another on the bottom surfaces, with which said bottom side is closed, leaving it ready to reinitiate the steps described, while at the same time, at the middle of the single weld or between the two seams in the second embodiment, the cutting blade makes a cut which separates the package, leaving the farmed package on an exit belt and ready to be loaded or handled as the case may be.

For the purpose of compactly closing the package with a predetermined number of bags, when the loading of the bags inside the sleeve is completed, there is an area of horizontal sealing at the midpoint of a distance between the lower edge of the sleeve-forming tube and the upper surface of the last bag, which must be equal to the distance between the center of the package and the side of the sleeve upon which the thermal clamps make a closing transverse weld on the top side of each package wrapping and on the bottom side corresponding to the wrapping of the next package.

In this manner a package of snack-filled bags is obtained, closely wrapped in thermoplastic film, with a stable and compact shape, wherein the individual bags are stacked one on top another and their contents are protected from breakage during the packaging, wherein said package comprises upper and lower transverse welds with a lateral gusset that delineates flat upper and lower areas and a longitudinal weld along one of its lateral sides.

Industrial Application of the Invention

The present invention is applicable in the purview of the division into solid products in pieces, granules, and/or powdered form, preferentially foodstuffs, most preferentially those of fragile constitution such as snacks, and especially in those metallurgical industries engaged in the manufacturing of complete machines and their parts, which will be greatly benefitted by having at their disposition methods for wrapping product-filled bags together, a machine applicable to such methods, and the package of snack-filled bags thus obtained, all of which offer solutions to the problems that exist in the state of the art in those lines of high velocity retail packaging by being able to obtain packages of product-filled bags that are much more compact and stable for shipping and handling.

Final Considerations

Different modifications and variations of the methods for wrapping product-filled bags together, a machine applicable to such methods, and the package of snack-filled bags thus obtained, as described in the present invention, will be evident to experts in the technology without thereby departing from the scope and spirit of the invention. Although the invention has been described in relation to preferred embodiments, it must be understood that the invention as it has been claimed should not be unduly limited to said specific embodiments. In fact, it is intended that the different modifications of the described way of carrying out the invention which are obvious to experts in the corresponding state of the art or in related fields, be included in the scope of the following claims.

The claims form part of the description of the invention which is the subject of this patent application.

Having thus expressly described and determined the nature of the present invention and how to put it into practice, what is claimed, as an exclusive right and property, is:

1. A machine to wrap bags, wherein the machine is mounted on a vertical frame and comprises:

synchronized endless belt conveying means comprising a lower first belt and an upper second belt arranged in different overlapping and parallel planes such that between them is formed a passageway for the product-filled bags onto a support;

a feeder of thermo-adhesive plastic laminar film which feeds into a chamber forming a wrapping sleeve for the bags which are packed one on top of another, wherein said chamber comprises a shoulder and a sleeve-forming tube, said sleeve being partially shaped by a lower transverse welding seam defining its bottom;

horizontal welding means for welding the top and bottom surfaces of the wrapping sleeve, as well as vertical welding means for welding the corresponding overlapping longitudinal edges of the film, of which the horizontal welding means are located under the outlet of the sleeve-forming tube and comprise thermal clamps used to make a closing transverse welding of the top side of the wrapping of each package and the corresponding bottom of the wrapping of the next package, with cutting means to separate the formed packages from each other while the vertical welding means are formed by a set of thermal clamps located on a plane lower than the support and above the sleeve-forming tube, coinciding with the line of overlap between the longitudinal edges of the wrapping sleeve;

a bag intake box formed by an enclosure internally comprising the horizontal support of the bags that are delivered by the conveying means and an adjacent inlet opening to the sleeve-forming tube;

horizontally-acting pushing means that activate a movably mounted plate which sweeps the horizontal support surface toward the sleeve-forming tube, and vertically-acting pushing means arranged over said intake box and an axis of action of which is collinear to an axis of the sleeve-forming tube, wherein said vertically-acting pushing means comprise a generally horizontal plate and when activated, said horizontal plate presses against the at least one bag supported over the opening of the sleeve-forming tube and pushes the formed wrapping sleeve and its contents through the outlet of the sleeve-forming tube.

2. The wrapping machine according to claim 1, characterized in that the conveying means comprise an inclined first conveyor and a horizontal second conveyor which download onto the horizontal support of the intake box.

3. The wrapping machine according to any of claims 1 to 2, characterized in that the horizontal welding means comprise a set of thermal clamps used to form a transverse welding strip to close the top side of the wrapping of each package and the corresponding bottom of the next package, with cutting means to separate from one another the packages thus formed in the middle of the strip.

4. The wrapping machine according to any of claims 1 to 2, characterized in that the horizontal welding means comprise two sets of thermal clamps, with the lower one used to make the closing transverse weld for the top side of the wrapping of each package, and the upper one to make the closing transverse weld for the corresponding bottom of the next package, with cutting means to separate from one another the packages thus formed in the empty space that exists between the two weldings.

5. The wrapping machine according to any of claims 1 to 2, characterized in that the horizontally-acting pushing means comprises a horizontal pushing cylinder.

6. The wrapping machine according to any of claims 1 to 2, characterized in that the inlet opening of the sleeve-forming tube comprises means to support the bags on its edge.

7. The wrapping machine according to any of claims 1 to 2, characterized in that the vertically-acting pushing means comprises a servomechanism.

8. The wrapping machine according to claim 7, characterized in that the plate of the vertically-acting pushing means is concave.

9. The wrapping machine according to claim 8, characterized in that a detecting sensor in the opening of the sleeve-forming tube is an electric eye that detects when the at least one bag has been placed in the opening of the sleeve-forming tube, enabling the activation of the vertical pushing servomechanism to push said bag through the mouth of the sleeve-forming tube, causing the advance of the bags and sleeve together.

10. The wrapping machine according to claims 8, characterized in that a sensor in the sleeve-forming tube is an electric eye that detects when a predetermined number of bags has completely passed through said sleeve-forming tube, completing the stack within the package, which enables the activation of the thermal clamps used to make a transverse closing weld on the top side of the wrapping of each package and of the corresponding bottom of the wrapping of the next package, and immediately thereafter, the activation of the cutting means that separates the formed packages from each other.

11. The wrapping machine according to claim 8, characterized in that an intake sensor for each bag is an electric eye that detects when at least one bag has fully entered into said intake box on the support, enabling the horizontal pushing cylinder to push the at least one bag into the opening of the wrapping sleeve-forming tube.

12. The wrapping machine according to claims 1 or 8, characterized in that for the purpose of compactly closing the package with a preset number of bags, when the loading of bags into the sleeve is completed a horizontal sealing area is determined at the midpoint of a distance between the lower edge of the sleeve-forming tube and the upper surface of the last bag, which must be equal to the distance between the center of the package and the side of the sleeve on which occurs the action of the thermal clamps used to make a closing transverse weld on the top side of the wrapping of each package and the bottom corresponding to the wrapping of the next package.

13. The wrapping machine according to claims 1 or 8, characterized in that the sensors can be calibrated so that the conveying means feed bags onto the support in such a way as to form stacks of at least two bags, such stacks being pushed first horizontally, causing them to move onto the adjacent opening of the sleeve-forming tube, and then vertically, causing the descent of the whole stack with its wrapping until the package is completed by stacking a predetermined number of bags inside the wrapped sleeve.

14. The wrapping machine according to any of claims 1 to 2, characterized in that the intake box is constituted by a frame of rigid walls, of which the front one comprises an inspection window, the walls establishing a space whose capacity is compatible with the flat-lying bags entering into said space, wherein the upper part of said space is open, while the lower part constitutes a support for the bags and adjacent to it is the opening of the sleeve forming tube, wherein the side of the support is constituted by a plate associated with a horizontally-acting pushing cylinder which transfers the bags onto the edge of the sleeve-forming tube, thus freeing the support, in such a way that a vertically-acting servomechanism then pushes the bags with a plate associated with its lower end through said sleeve-forming tube and into the wrapping sleeve, wherein said box is fed with bags by the conveying means, and wherein the plate of the horizontal pushing cylinder is activated in response to the intake of at least one bag into the box cavity by a sensor, the plate of the vertical servomechanism is activated in response to the transfer of at least one bag to the opening of the shaping tube by another sensor, and the welding clamps are activated in response to a counting sensor which counts the bags passing through the sleeve-forming tube.

15. A machine for wrapping bags, wherein the machine is mounted on a vertical frame and comprises:

conveying means comprising a horizontal conveyor belt, a vertical-lifting elevator wheel, and a lower first belt and an upper second belt arranged in different overlapping and parallel planes forming a passageway for the bags toward an opening of a sleeve-forming tube;

a feeder of thermo-adhesive plastic laminar film which feeds into a pavilion that shapes a wrapping sleeve for receiving the bags stacked one on top of another, where said pavilion comprises a shoulder and the sleeve-forming tube, with this wrapping sleeve being partially formed starting from a lower transverse welded seam that defines its bottom;

horizontal welding means being located underneath the outlet of the sleeve-forming tube and comprising thermal clamps used to form a transverse closing weld for the top side of the wrapping sleeve for one formed package and the corresponding bottom of the next formed package with cutting means to separate the formed packages;

vertical welding means formed by a set of thermal clamps located on a plane below that of the outlet of the sleeve-forming tube, coinciding with the line of overlap between the longitudinal edges of the wrapping sleeve;

horizontally-acting pushing means that push the individual bags from their position on the vertical-lifting elevator wheel toward the horizontal conveying means;

a bag intake box formed by an enclosure which internally comprises an inlet opening to the sleeve-forming tube for the bags that are delivered by the conveying means;

vertically-acting pushing means located over said intake box, the axis of action of which is collinear with the axis of the sleeve-forming tube located below it, wherein said vertically-acting pushing means comprise a generally horizontal plate and that when activated, said horizontal plate presses against the at least one bag supported over the opening of the sleeve-forming tube and pushes the formed sleeve and its contents through the outlet of the sleeve-forming tube toward the horizontal welding means and an exit belt located below the sleeve-forming tube to transport the formed packages.

16. The wrapping machine according to claim 15, characterized in that the horizontal welding means comprise a set of thermal clamps to be used to make a strip of transverse welding to close the top side of the wrapping of each package and of the corresponding bottom of the next package, with cutting means to separate the formed packages from each other in the middle of the strip.

17. The wrapping machine according to claims 15 or 16, characterized in that the horizontal welding means comprise two sets of thermal clamps, the lower one to be used to make the transverse closing weld of the top side of the wrapping of each package, and the upper one to make the transverse closing weld of the corresponding bottom of the next package, with a cutting mechanism to separate the formed packages from each other in the empty space that exists between the two weldings.

18. The wrapping machine according to claims 15 or 16, characterized in that the horizontally-acting pushing means comprise a horizontal pushing cylinder.

19. The wrapping machine according to claims 15 or 16, characterized in that the inlet opening to the sleeve-forming tube comprises supporting means for the bags.

20. The wrapping machine according to claim 19, characterized in that the supporting means are outward-opening entry flaps placed parallel on two opposite sides of the opening of the pre-former/sleeve-forming tube.

21. The wrapping machine according to any of claim 15, 16, or 19, characterized in that the opening of the sleeve-forming tube comprises a pre-former constituted by two elements across from each other, folded over the corners of said sleeve-forming tube, the ends of which are fixed at the center of two opposite lateral faces of the tube, in such a way that these elements present an oblique extension for the folding down of the corners of the bags down along their lateral sides.

22. The wrapping machine according to claims 15, 16, or 19, characterized in that the vertically-acting pushing means comprise an electromechanical system.

23. The wrapping machine according to claim 22, characterized in that the pushing plate of the vertically-acting means is concave.

24. The wrapping machine according to claims 15, 16, or 19, characterized in that the intake box is constituted by an enclosure with rigid walls, of which the front wall comprises an inspection window, which demarcate a space whose capacity is compatible with the flat-lying bags that enter it, where the upper part of said space is open, while the inner part is constituted by support means in the opening of the sleeve-forming tube, where a vertically-acting servomechanism pushes the bags with an associated rigid plate at its lower end through said sleeve-forming tube and into the wrapping sleeve, where the aforementioned box is fed with bags by a set of horizontal conveying means, and where the plate of the horizontally-acting pushing cylinder is activated in response to a sensor having detected that a bag has reached a predetermined height by means of the lifting wheel, toward said group of horizontal conveying means, the plate of the vertical servomechanism is activated in response to the transfer of at least one bag onto the opening of the forming tube by another sensor, and the welding clamps are activated in response to a sensor that counts the bags which pass through the sleeve-forming tube.

25. The wrapping machine according to claim 24, characterized in that a detection sensor on the opening of the sleeve-forming tube is an electric eye that detects when at least the one bag has been deposited on the opening of the sleeve-forming tube and enables the activation of the vertical pushing servomechanism to push said bag through the mouth of the sleeve-forming tube, bringing about the advance of the bags and sleeve together.

26. The wrapping machine according to claim 24, characterized in that a sensor in the sleeve-forming tube is an electric eye which, detecting when a predetermined number of bags has passed all the way through said sleeve-forming tube and completed the stack within the package, enables the activation of the thermal clamps used to make a transverse weld closing the top side of the wrapping of each package and of the bottom corresponding to the wrapping of the next package and immediately afterwards of the cutting means that separates the formed packages from each other.

27. The wrapping machine according to claim 24, characterized in that, for the purpose of closing the package compactly with a predetermined number of bags, when the loading of bags into the sleeve is completed, a horizontal welding area is established at the midpoint of the distance between the lower edge of the sleeve-forming tube and the upper surface of the last bag, which must be equal to the distance between the center of the package and the side of the sleeve, which is acted upon by the thermal clamps used to perform a transverse closing weld on the top side of the wrapping of each package and on the corresponding bottom of the wrapping of the next package.

28. The wrapping machine according to claim 15, characterized in that the sensors are calibrated so that the conveying means feed bags onto the support means of the intake box in such a way as to form stacks of at least two bags, said stacks being pushed vertically to accomplish the joint descent of the bags and sleeve until the package is completed by stacking inside it a predetermined number of bags enveloped by the sleeve.

* * * * *